US005163377A

United States Patent [19]

Calderon et al.

[11] Patent Number: 5,163,377

[45] Date of Patent: Nov. 17, 1992

[54] SAILING YACHT

[75] Inventors: Albert A. Calderon, La Jolla, Calif.; Charles W. Robinson, Santa Fe, N. Mex.; Matthew B. Brown, San Diego, Calif.

[73] Assignee: Dyna-Yacht, Inc., La Jolla, Calif.

[21] Appl. No.: 699,311

[22] Filed: May 9, 1991

[51] Int. Cl.[5] ..... B63B 1/04; B63B 3/38; B63H 9/04; B63H 25/10

[52] U.S. Cl. ..... 114/39.1; 114/56; 114/91; 114/125; 114/143; 114/163

[58] Field of Search ..... 114/39.1, 56, 125, 167, 114/163, 140, 143, 91, 128, 129, 162

[56] References Cited

U.S. PATENT DOCUMENTS

| | | | |
|---|---|---|---|
| 559,983 | 5/1896 | McLean | 114/91 |
| 648,911 | 5/1900 | Beardsley | 114/143 |
| 2,024,822 | 12/1935 | Hort | 114/125 |
| 2,972,324 | 2/1961 | Williams | 114/163 |
| 3,140,686 | 7/1964 | Olivotti | 114/56 |
| 3,324,815 | 6/1967 | Morales | 114/143 X |
| 3,903,827 | 9/1975 | Marcil | 114/143 |

FOREIGN PATENT DOCUMENTS

| | | | |
|---|---|---|---|
| 2709666 | 12/1978 | Fed. Rep. of Germany | 114/162 |
| 43397 | 2/1987 | Japan | 114/167 |

OTHER PUBLICATIONS

Sail Magazine "A Taste of Tomorrow" Jan. 1981.

Sail Magazine "A Peek at the Geek" Feb. 1987.

Soundings "Trade Only" Mar. 1988.

Sea Horse "Off the Record" Gary Mull Jul./Aug. 1986.

San Diego Union "Sails Wave of Future" Bill Center Dec. 26, 1986.

C. A. Marchaj, Appendix 2 Aero-Hydrodynamics of Sailing pp. 689-709 and page marked Notes to Appendix 2 1988.

A. Calderon paper "The Keeless Twin Wing 12-Meter Yacht USA" published 1988 in the Proceedings of the Interface Oct. 1987.

*Primary Examiner*—Sherman Basinger

*Attorney, Agent, or Firm*—Robert B. Block

[57] ABSTRACT

High performance sailing yacht designs are disclosed based on a keelless sailing yacht concept having fore and aft cambered foils for leeway control which foils replace the function of the standard keel. A keelless sailing yacht of this type is disclosed with dynamic ballast which is laterally movable to apply a variable counter-heeling force; a tiltable mast which may have a rotatable mast and sail leading edge; cambered foils for cyclic and collective steering; and adjustable camber controls for adjusting lift and leeway. The foregoing features allow disclosed improvements and modifications to hull design in having a duplex hull form, with lower and upper hull shapes, the lower of low drag shape, and of reduced section, while the upper hull extends laterally abeam from the lower hull for added buoyancy when heeled and for accommodation room.

50 Claims, 15 Drawing Sheets

Fig. 26
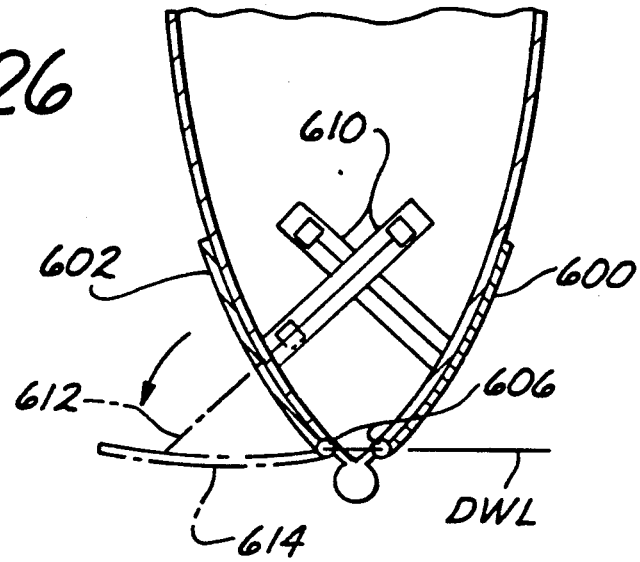
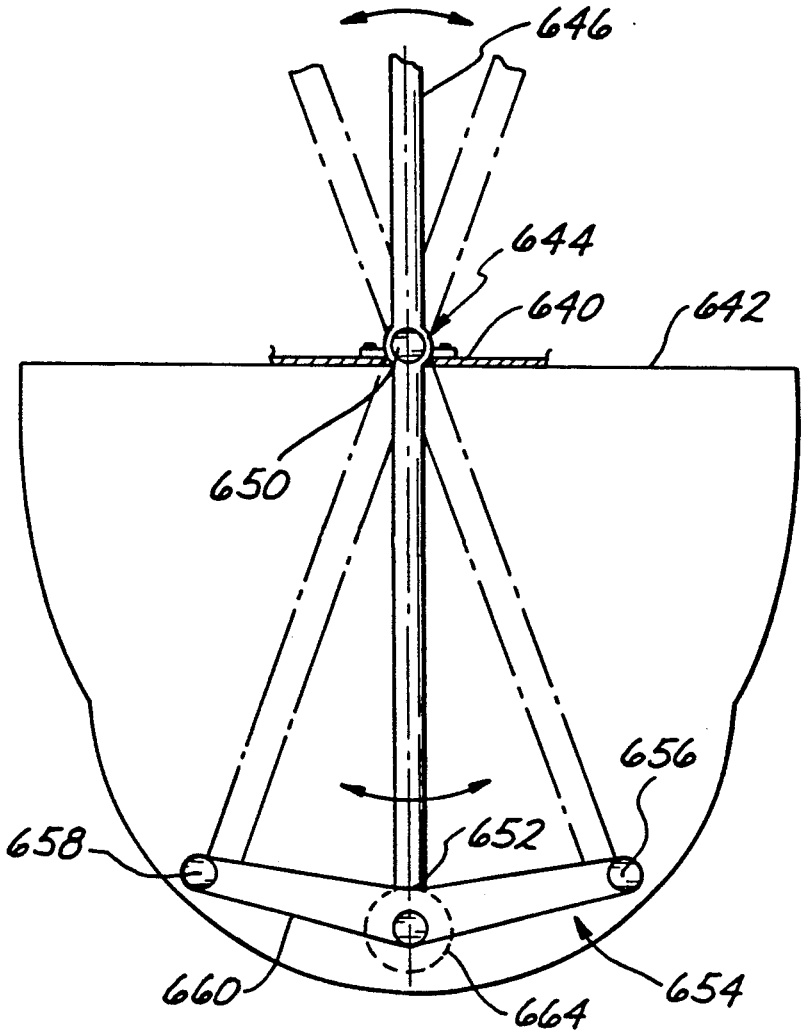
Fig. 27

SAILING YACHT

BACKGROUND OF THE INVENTION

The present invention relates to sailing yachts and to a high performance keelless sailing yacht with fore and aft cambered foils for leeway control. The invention further relates to a keelless sailing yacht with dynamic ballast which is laterally movable to apply a variable counter-heeling force; a tiltable mast; cambered foils for cyclic and collective steering; and adjustable camber controls for adjusting lift and leeway. The foregoing features allow disclosed improvements and modifications to hull design.

In the keeled yacht, as is now known, leeway and heeling are controlled by a ballasted keel which extends fore and aft of the hull and below the same along the centerline or midplane. Steering is controlled by a rudder working with the keel to displace water laterally as the boat is moved which is then transmitted to the stern of the vessel as a sideways force. The keel is normally laterally fixed in position at the midplane but may be raisable or combined with a center board which may be raised. Even so, the fixed keel of the conventional sailing yacht is multifunctional, combining in a single appendage the functions of lateral resistance to leeway and righting moment from the ballast. As such, the righting moment and lateral resistance to leeway are design parameters that are established in the plans of the yacht and in its construction and are not adjustable thereafter. As a consequence, the angle of heel can only be further changed by adjustable internal ballast or by moving crew weight; but leeway is normally not adjustable once the yacht is built. The necessity of some leeway has always been presumed. All of the above factors are limitations and disadvantages of known yacht designs.

OBJECTS OF THE INVENTION

It is a general object of the present invention to provide a high performance sailing yacht which will overcome the above-mentioned limitations and disadvantages.

It is a further object of the present invention to provide a high performance sailing yacht of the above character where the functions of counter-heeling force provided by the external ballast, and leeway control formerly supplied by the shape and extent of the keel, are transferred to new appendages, the conventional ballasted keel being eliminated and replaced by fore and aft sailing foils for leeway control and steering, and by a dynamic, laterally shiftable ballast to obtain desired counter heeling force and to maintain angle of heel.

It is a further object of the present invention to provide a sailing yacht of the above character having a dynamic ballast mounted to a laterally swingable strut for adjustment to extreme angles to provide counter-heeling forces and other additional benefits.

It is a further object of the present invention to provide a sailing yacht of the above character employing underwater sailing foils depending fore and aft of the midships of the hull for steering and for leeway and directional control.

It is a further object of the present invention to provide a sailing yacht of the above character having fore and aft foils mounted to depend from the locations forward and aft thereon and for rotation about generally vertical axes in response to cyclic and collective turning means which are operationally independent of each other.

It is a further object of the present invention to provide a sailing yacht of the above character in which the sailing foils are provided with flaps for adjusting camber and lift.

It is a further object of the present invention to provide a sailing yacht of the above character which further employs a mast and support system for the mast in which the mast can be tilted to port or starboard as a normal adjustment to sailing conditions.

It is a further object of the present invention to provide a sailing yacht of the above character wherein the new concepts of laterally adjustable external ballast with fore and aft sailing foils allow separation of the functions of counter-heeling forces, steering, and leeway control in such a manner that the side forces are countered more effectively thus allowing a redesign of the hull with reduced surface area and drag; an enhanced directional control; and improved safety with increased broaching resistance.

It is a further object of the present invention to provide a sailing yacht of the above character in which the ballast is shaped for laminar flow, with a generally torpedo shape, and is supported by a strut which may be swung about its mounting laterally up to at least 55 degrees from the midplane of the hull to thereby not only provide a more efficient counter-heeling force, but also to eliminate interference to water flow past the fore and aft foils.

It is a further object of the present invention to provide a sailing yacht of the above character which achieves a significant reduction in the angle of heel and the adverse effects from usual tilting of the mast and rigging that results from wind pressure by providing lateral counter-tilting of the mast which may be employed to position the mast toward or beyond vertical with respect to the water surface, to reduce the mast heeling force or when beyond vertical, to generate a counter heeling force, to decrease downward wind pressure on the hull, or, when tilted beyond vertical, to generate a lifting force, and allowing redesign of the mast and rigging structures for greater ruggedness, and for self-support.

It is a further object of the present invention to provide a sailing yacht of the above character in which the reduction of heeling forces and the control of leeway enabled thereby allows the use of semi circular hull forms (in section) below the water line for reduced drag and increased speed.

It is a further object of the present invention to provide a sailing yacht of the above character in which an entirely new concept of hull design may be employed, incorporating a dynamic ballast system by which internal water ballast can be added or expelled to raise and lower the water line of the hull; a so-called "duplex" hull of improved form having a lower sailing hull section of reduced diameter to maximize strength and minimize wetted surface, overall drag and weight on certain points of sail; and an upper hull section above the water line for greater stability and in port comfort.

It is a further object of the present invention to provide a sailing yacht of the above character having a dynamic water ballast system.

It is a further object of the present invention to provide a sailing yacht of the above character which is provided with a tiltable mast arrangement to maintain the mast position at or beyond vertical to the water surface.

It is a further object of the present invention to provide a sailing yacht of the above character having an integrated electronic drive system using a mechanical or gyroscopic inertial sensors for outputs applied to controllers for shifting the external ballast for heeling control and for tilting the mast to increase the effective sail cross-section.

It is a further object of the present invention to provide a sailing yacht of the above character having adjustable bow wings for providing lift when sailing to windward in waves; hydroplaning when sailing downwind; damping of boat pitch oscillations, and extraction of forward directed energy from wave actions.

It is a further object of the present invention to provide a sailing yacht of the above character having a tilting mast with aero-dynamic cross-section which can be rotated by wind force on the sail or mechanically to be aligned towards the wind to preserve the aerodynamic benefits of the mast cross-section, to avoid air flow distortion from the mast and to orient the sail for maximum efficiency.

These and other features and objects of the invention will become apparent from the following summary and detailed description when taken in conjunction with the accompanying drawings and claims.

SUMMARY OF THE INVENTION

The present invention is predicated on the realization that the combined functions normally assigned to the keel of a sailing yacht can be better effected without a conventional keel. Instead, a laterally swingable ballast is provided and carried on a strut, the portion of which is adjustable to provide the desired counter-heeling force, but which need provide no particular leeway control. Fore and aft underwater sailing foils of high efficiency and adjustable camber provide greatly enhanced steering and directional control, and, further enable the yacht so provided to sail with controllable and adjustable leeway, which may indeed be zero.

More particularly, the present invention provides a keelless hull in which the hydrodynamic side force function (leeway control) and gravitational ballast function (angle of heel control) required for upwind sailing are provided by new and separated appendages. A heavy streamlined ballast appendage is mounted at good depth separate from and under the mid-body of the hull by means of a narrow strut swingable to port or starboard from a bearing in the hull to adjust the lateral position of the ballast and the amount of counter-heeling force.

Fore and aft foils provide leeway, rolling and steering control, and roll damping functions which are structurally and hydrodynamically separated from the ballast appendage. The foils are mounted under the hull forward and rearward respectively, of the ballast appendage and adjacent to the fore and aft portions of the wetted regions of the hull. A linkage system turns both foils on their vertical axes in the same angular direction, collectively, to provide hydrodynamic side forces normal to the hull centerline to oppose the side force of the wind on the hull and sails. Other Linkages are provided for turning the foils in opposite directions or differentially to provide yawing couples to the hull for cyclic steering. The foils are equipped with variable camber high lift flaps to minimize profile drag downwind and to provide high side forces with good lift to drag ratios for upwind performance.

The ballast appendage is shaped and placed for lowest volume and is either at a lowest center of gravity position relative to the water surface (downwind sailing) or laterally shifted out of the path of water flowing across the foils. In the present yacht, the wave making drag is free of adverse interactions such as exist in conventional designs between hull and fin keel. A large efficient hydrodynamic span of the foils further minimizes induced drag, as compared to the short span fin keel of conventional design. Providing a low wetted area and efficient camber of the foils and eliminating the hull's bustle further minimizes profile drag. The new yacht and hull with these features has exceptionally low resistance upwind and downwind, and high performance.

Having controlled the counter-heeling forces by an effective laterally shiftable ballast, it is possible to bring the yacht to very low angle of heel, say within 5 to 15 degrees of vertical or possibly 20 degrees at the maximum, under most conditions. This makes it possible to employ a different mast and rigging system for the sails in which the mast may be cantilevered from the deck and largely self supporting with a support system allowing it to be tilted to a more nearly vertical position and counter to the heeling forces; the tilting mast can also rotate about its long axis for best alignment into the wind.

The increase in performance brought about by the deployment of shiftable ballast and sailing foils in the manner described in the present invention provides a considerable increase in sailing efficiency which when coupled with a tiltable mast brings the concept of a high performance sailing yacht capable of optimized hull forms with zero leeway sailing and the possibility of maximizing thrust forces for speed.

So now the concept of a dynamic yacht comes into view wherein, by separating the functions to be achieved, it becomes possible to deal with the various functions of the yacht's sailing operations, each, as an independent dynamic variable, thus, separation of the side force appendages from the ballast appendage allows the side force appendages to be located away from the mid-hull wave trough, placing them instead near the bow and stern wave crests; where they are more effective.

There are three basic functions: to provide vessel directional control as in changing direction in a tack, to counter or offset leeway, and to provide a counter-heeling force. In having separated these functions, the counter-heeling function can be performed more effectively by articulating the ballast out of interference with the means for providing the lateral force resistance. Twin foils, fore and aft, with camber, provide a more effective resistance to lateral force because the boat is maintained in a more vertical position by the articulated ballast. The steering and directional control of the boat is also increased by having separated foils as opposed to a single rudder in the stern. As a result, the yacht will have better control, much better resistance to broaching, and be a much safer boat for an amateur to operate.

Developing an integrated system where one can either effectively change direction or maintain direction and so the control of the camber as well as the foil position itself is determined by whether one wants to change direction or whether one wants to maintain it. The structures provided by the present invention integrate the two foils together to perform either function in a unitary system having both cyclic steering and collective tillers at the helm. The invention provides for independent operation through separate and distinct means of cyclic and collective steering system even though many of the parts of each steering system are common with the other.

It should be mentioned that the forward and rear foils of the present invention are not to be considered as rudders. The word rudder means an appendage that provides a lateral forces at the stern for steering a boat. And a keel normally provides a lateral force to prevent or diminish leeway. Now when the functions of a standard keel are separated, and the steering and side force functions are carried out with two foils, each contributes to the side force to diminish leeway, while at the same time providing a steering function when angularly deflected in opposition to each other. The word rudder is more limited in that it denies the possibility of using it as a primary component of anti-leeway control Then, the ballast function, the counter-heeling function, may be placed more amidship, effectively separated from the side foils. Once this concept is accepted, the possibility is then introduced of making the ballast, or the counter-heeling force, dynamic, that is adjusting to increasing heeling force. This does two things: the ballast moves away from the center line, it increases the effectiveness of the forward foil by not interfering with the water flow from the forward foil; and, it also increases the counter-heeling force, tending to reduce overall heeling. And this is an important factor that's made possible by the separation of these two factors. Now, the foils themselves are important in resisting the lateral force, but also important in getting improved directional control for the boat, and important in increasing the safety of the boat by making it almost broach resistant so that an inexperienced sailor, even under extreme conditions, is less subject to the threat of broaching. Once the ballast is separated from the side force appendages, not only is the interference of the water flow eliminated from that forward foil, but you restrict the boat heeling to increase comfort in operating the boat, you reduce the amount of mast tilting that would be required to maintain a vertical mast.

This introduces the possibility of using a circular hull shape which has diminished or even no hull form stability, because the yacht is being righted with a more effective program of shifting of the external ballast. As used herein in respect to the description of hull form, the word "circular" is meant in its general meaning to signify that the referred to portion of the hull at each section (transverse section through the hull) lies along a generally circular curve so that its shape may be said to be circular while that portion extends only through a portion of a circle such as a quadrant, semicircle or portion of a circle.

There are advantages in introducing a lower hull form which is semi-circular in cross-section, a hull of maximum strength; minimized weight, minimized surface area and therefore drag; and reduced wave making resistance because the volume can be generated with a minimum beam. With a narrow circular hull, there still remains the need to provide safety in hull form stability and reserve buoyancy. But that can be done by making the hull's draft and waterline length, and even at the waterline beam, dynamic factors in the hull design as well. Thus, a lower circular hull is provided for sailing with minimum weight and drag, which is coupled with an upper, more bulbous buoyancy hull which doesn't effect the normal efficiency of sailing to that design water line. Although the yacht sails on an almost circular sailing hull, one could raise the waterline and lower the boat by pumping or allowing water into ballasting tanks. Thus, a dynamic ballast system is provided with the opportunity of adjusting to another load water line and a different hull shape for different conditions such as in-port sailing, for greater stability and/or waterline length under extreme weather conditions, or for downwind sailing where the planing action of a wider, bulbous hull and/or its reserve buoyancy could be an advantage.

In the duplex monohull permits a multiple waterline beam and/or water line length approach to hull form design; buoyancy/ballast tanks are provided in the bow and the stern and laterally on the side, both port and starboard side, near the midsection, which tanks can be flooded or cleared to raise or lower the water line, lower the boat, or can be evacuated either by pumping action or probably more efficiently through compressed air on the tanks that would force the water out fairly rapidly to raise the boat to a normal, fast and/or lighter sailing position, depending on wind strength.

An additional factor included in the concept of the present invention is the ability to keep the mast in a vertical position. This maintains the maximum cross-sectional area and therefore maximum wind force on the boat under wide range of conditions.

The mast is therefore mounted for side to side tilting movement under the control of mechanical supports that include motors for supporting the mast in the tilted position, either to port or to starboard.

The dynamic ballast system and the tilting mast are preferably coordinated to maintain the mast at or beyond a vertical position, controlled at a given angle of heel through an integrated system of electrical controls including a gyro or other device which measures the heeling angle and develops electrical signals to control 1) the verticality of the mast, and 2) the optimum lifting of the ballast force to maintain optimum heel.

As an additional dynamic factor in the hull design of the present invention there is provided a bow wing arrangement for encouraging planing action and therefore avoid the speed limitations of conventional yachts. In one hull of the present invention for downwind sailing, the boat could be lowered to the second water line which brings in the upper hull bulge as a planing force factor. As an alternative and/or an addition to that may be an extension of bow wings which acts as a hydroplane to encourage the planing action. The bow wings can also provide lift when sailing upwind in the waves, actually lifting and/or pressing down the bow to dampen boat oscillations in pitch, and differentially to improve righting moments.

In summary, these features, the separation of side force appendage into two cambered vertical foils for maximum effective and minimum wetting surface area, the dynamic ballast, the construction of the hull into two sections, the lower circular section for fast sailing and more bulbous upper section, combined with the ability to operate at maximum efficiency in sailing but with maximum safety and buoyancy when lowered to the upper hull; further combined with a system for maintaining the verticality of the mast so as to maximize the efficiency in the use of the wind force, regardless of what heel the yacht may assume, when combined with the bow wings, provides a sailing yacht that can be adjusted to prevailing conditions to achieve maximally effective performance under a wide range of conditions.

BRIEF DESCRIPTION OF THE DRAWINGS

Both FIGS. 2 and 3 illustrate a yacht as it would appear while sailing on starboard tack with an approximately 10 to 15 degree angle of heel.

FIG. 26 is a cross-sectional view of the yacht of FIG. 23 taken along the lines 26—26 thereof and showing the bow wings fitted to the hull.

FIG. 27 is a cross-sectional view of a yacht similar to that shown in FIGS. 23-25 fitted with an alternate form of mast tilt system.

The following definitions are used herein describe the hull geometry:

A centerline is a line lying in the vertical longitudinal plane cutting the hull down the middle from bow to stern.

Waterlines (or level lines) are defined as the intersection of a series of vertically spaced horizontal planes cutting the centerline of the hull.

D.W.L. is the designed waterline on which the hull is intended to float.

L.W.L. is the load waterline on which the hull floats when ballasted.

Sections are defined as the intersection of a series of spaced vertical planes cutting the hull transversely to a centerline.

A midsection is one of the sections lying generally in the middle of the hull.

DESCRIPTION OF THE PREFERRED EMBODIMENTS

Referring now to FIGS. 1 to 6, the sailing yacht of the present invention is shown in detail with particular reference to the function of the laterally adjustable ballast.

Figure 1:
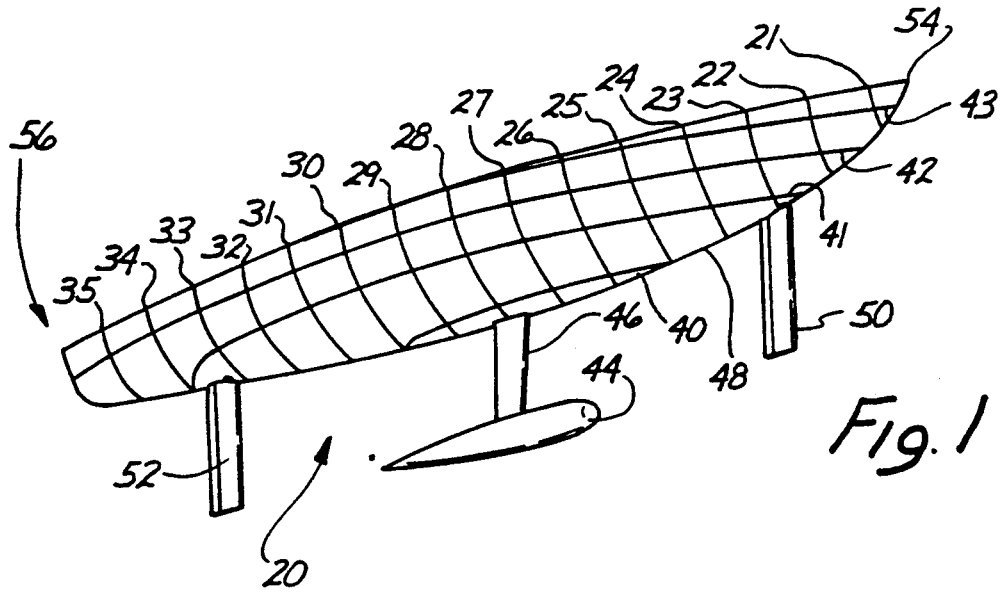
FIG. 1 is a perspective view of a sailing yacht constructed in accordance with the present invention as seen from below the water line and forward of a beam.

FIG. 1 shows a typical hull 20 and half model view with sections or bulkheads shown as lines 21-35, and water lines generally shown at 40-43. Ballast 44 is carried at the lower end of a strut 46 which is mounted and supported in a bearing block 47 laid internally in the bilge and in the lowermost part of the hull. Fore and aft hydrofoils, hereinafter foils, 50, 52 are mounted to depend vertically from the hull on midplane 48 and are positioned forward and rearward from the strut 46, respectively.

Figure 2:
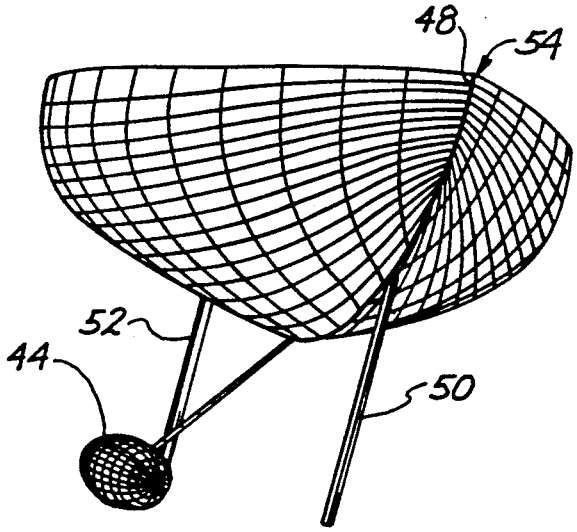
FIG. 2 is a perspective view into the starboard bow, showing the hull and underwater appendages, of the sailing yacht of FIG. 1 as seen from slightly below the water line.
Figure 3:
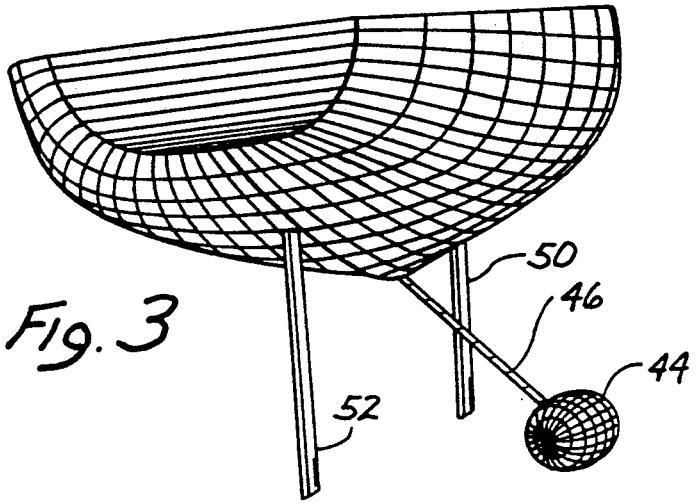
FIG. 3 is a perspective view into the starboard stern quarter of the sailing yacht of FIG. 1 as seen from slightly below the water line.

The hull 20 in FIGS. 2 and 3 has been shown with fairing lines and diagonal lines from the bow 54 to the transom stern 56 for giving visual shape to the hull for illustrative purposes only and do not correspond with the waterlines and section lines of FIG. 1. While the ballast is shown depending straight downward amidships in FIG. 1, it is shown moved approximately 30 degrees to starboard in FIGS. 2 and 3 so as to give righting moment to the hull which is illustrated as it would appear on starboard tack at about 15 degrees of heel.

Figure 4:
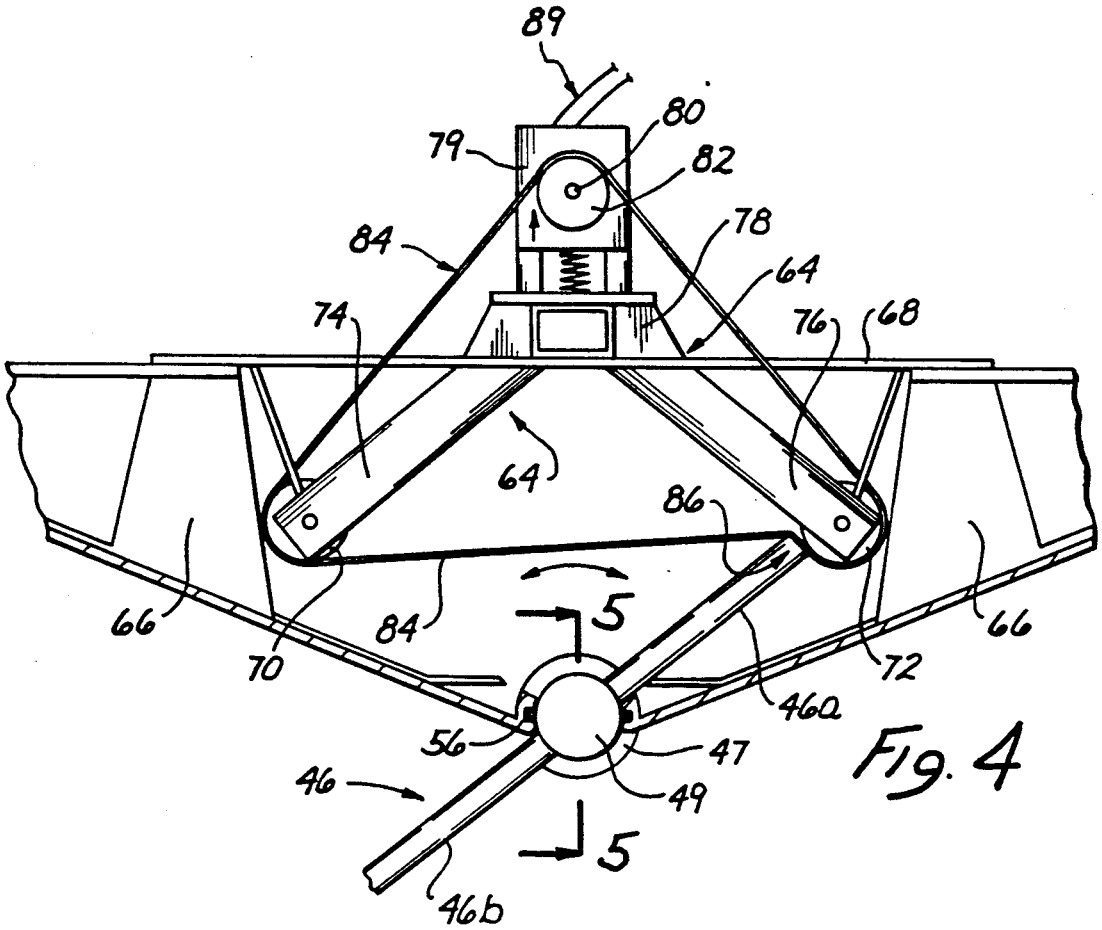
FIG. 4 is a transverse cross-sectional view of the yacht of FIG. 1 showing the drive mechanism and strut mounting assembly for shifting the strut and ballast.
Figure 5:
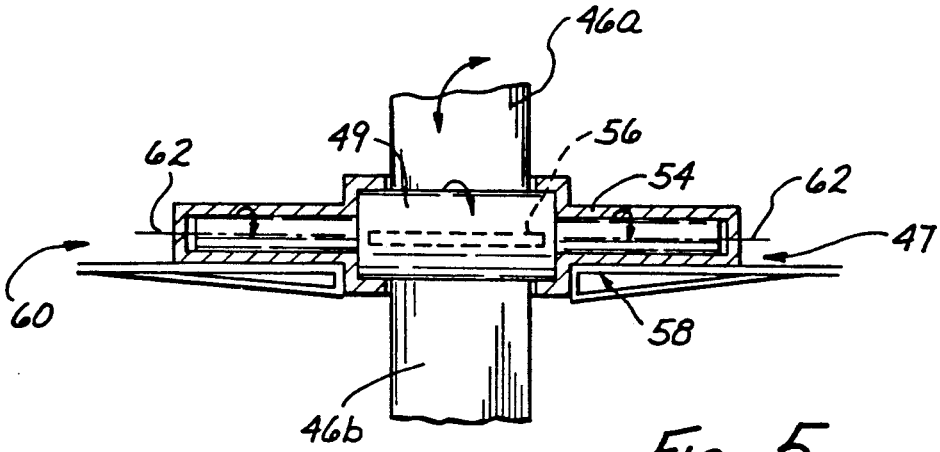
FIG. 5 is a fore and aft view along the centerline partly in section, of the ballast strut bearing of the strut mounting assembly of FIG. 4, taken along the lines 5—5 thereof.

FIG. 4 shows the mounting and drive arrangements for swinging the strut 46 to shift the ballast 44 laterally and includes a bearing block 47. The strut 46 is laid in the block with its upper portion 46*a* extending upwardly beyond the bearing block 47 to provide a lever arm for shifting the lower portion 47*b* of the strut and the ballast 44 accordingly. The strut 46 is secured and supported on a journal shaft 49 set into the bearing block and held with caps 54 and sealed from water leakage by suitable wiper seals 56.

The bearing block 47 may be supported by any suitable means as by being carried on a reinforced flooring section 58 molded into the hull at bilge 60. Bearing block 47 is oriented with its axis 62 fore and aft so that the strut 46 swings laterally of the hull about the shaft 49 on an axis 62 lying on the hull's centerline and low the bilge.

Means is provided for rotating the strut 46 in the journal bearing about axis 46 to thereby shift the ballast either to port or to starboard and includes an upside-down Y-shaped yoke 64 supported by a partial bulkhead 66 on a framework 68. Port and starboard pulleys 70, 72 are provided at the lower ends of yoke arms 74, 76. Upper yoke arm 78 carries a reversible motor 79 and shaft 80 carrying a drive pulley 82 about which is reeved a belt or linkage 84 which is also passed around the pulleys 70, 72 in the manner shown. The upper end 46*a* of the strut is carried back and forth by its point of attachment to the linkage at 86. The motor 79 and drive pulley 82 is mounted in a spring-loaded cage or housing 88 biased by a coil spring in compression to urge the housing upward for maintaining uniform tension in the belt at the extremes of travel. The motor 79 may be electrically operated from the yacht's electrical system or batteries through electric cables 89. The strut can also be rotated by hydraulic piston, mechanical gears or other powered or manual system.

Figure 6:
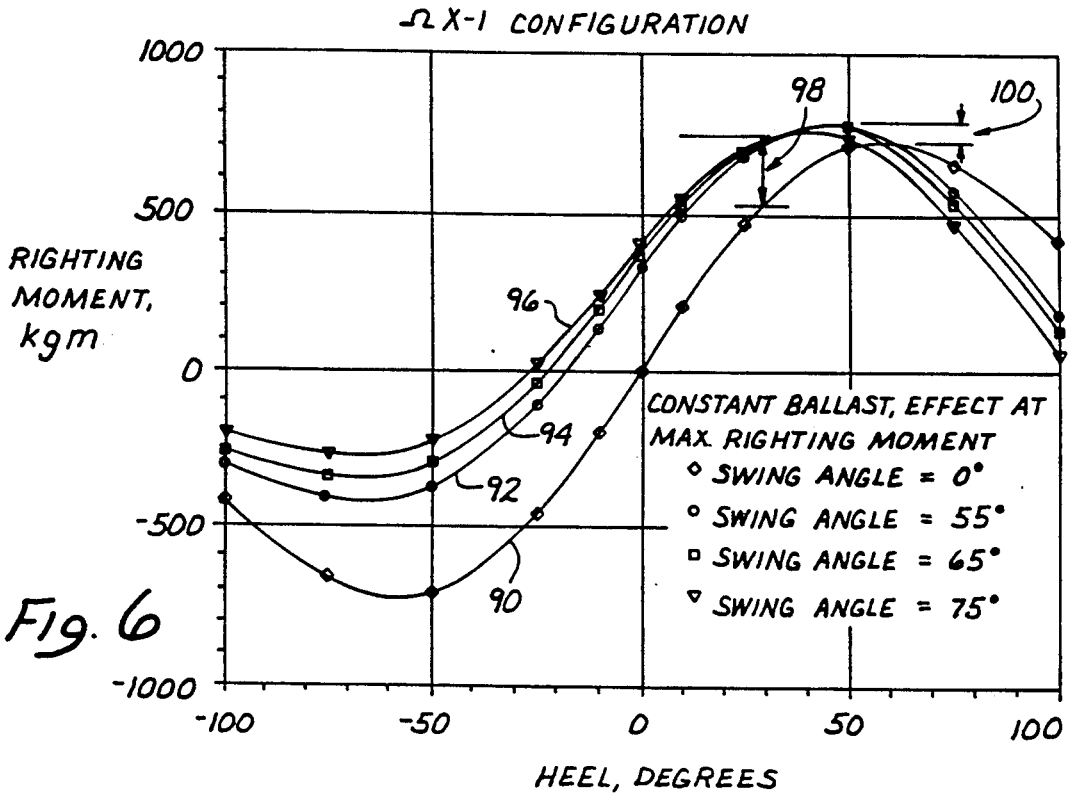
FIG. 6 is a righting moment sketch of the sailing yacht of FIGS. 1 through 5 for the purpose of analyzing and comparing the righting moment of the present yacht with a yacht having a standard ballasted keel.

Referring now to FIG. 6 there are shown graphs for the righting moment and forces of a yacht constructed in accordance with the present invention compared to a keel yacht. The keel yacht graph is shown at reference 90, while a yacht of the present invention carrying ballast at a swing angle at 55, 65 and 70 degrees is shown on lines 92, 94, and 96 respectively. As indicated by the incremental distance indicated at 98, the yacht of the present invention has an approximately 14 percent gain in righting movement of the standard yacht at 30 degrees of heel. At lesser degrees of heel the righting moment is made proportionately more effective as one approaches the lower angles of heel with the angle of swing maintained at approximately 55 degrees. It is also shown at 100 that at 50 degrees of heel there is approximately still 4 percent more restoring force than with a conventional yacht having non-moveable ballast.

Figure 7:
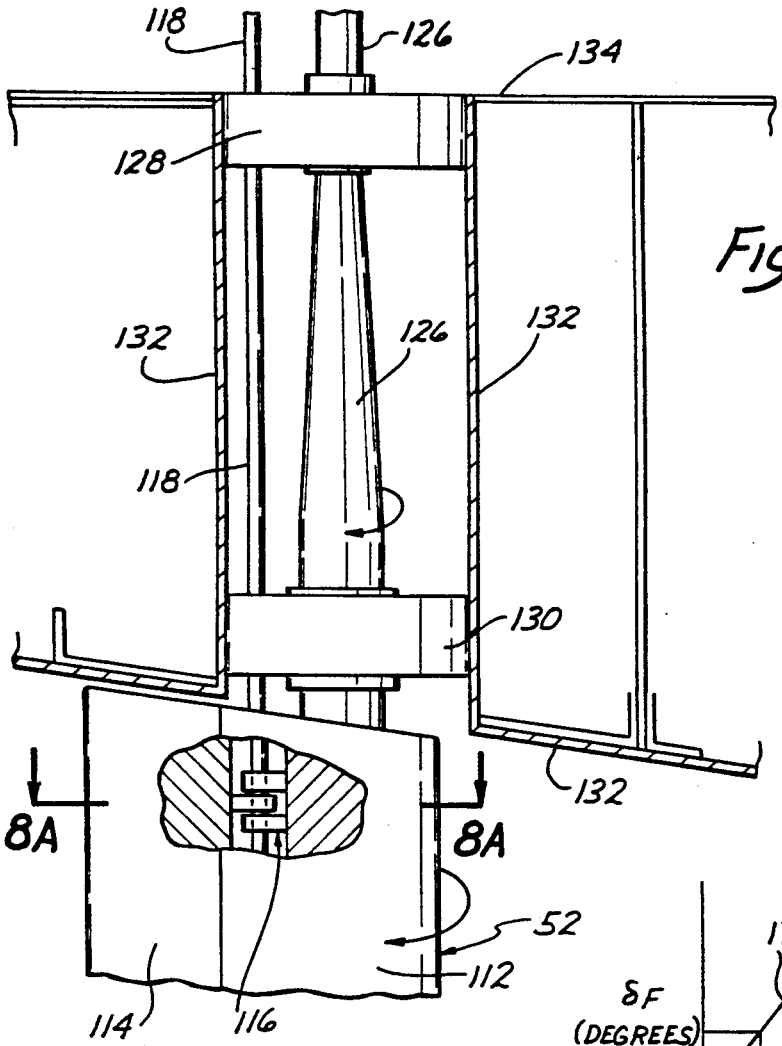
FIG. 7 is a elevational view taken partly in cross-section along the center line of the aft steering foil of the yacht of FIG. 1 with portions thereof broken away and shown in cross-section.
Figure 8B:
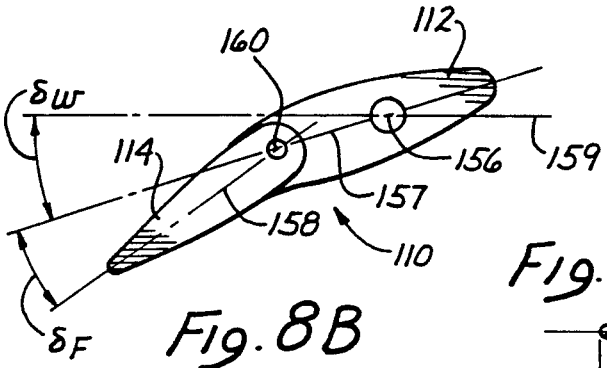
FIG. 8B is a cross-sectional view taken through the foil of FIG. 7 showing the same turned to an angle together with a flap angle set for a particular adjustable camber.
Figure 8A:
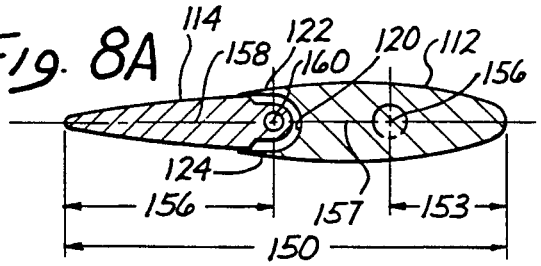
FIG. 8A is a cross-sectional view taken through the foil of FIG. 7 along the lines 8A—8A thereof.

Referring now to FIGS. 7, 8A and 8B, the construction of the aft steering foil 52, by way of example, and foil mounting arrangements for the yacht of FIGS. 1 through 3 is shown in detail the construction of the fore foil being substantially the same. As shown in FIG. 8A the foil 52 is provided with a hydro-dynamically laminar flow shape in overall cross-section so as to maximize streamlined flow of water about and around the foil and includes a body 112 to the rear of which a flap 114 is hinged on hinge blocks 116 by a rod 118 fixed to the flap for rotating it to adjust foil camber. The flap 114 and foil body 112 are merged together to conform to the desired shape with the forward side of the flap being inserted into a rearward facing recess 120 in the aft of the body 112 alongside of which are rearwardly extending skirts 122, 124 for smoothly covering the transition between them.

The foil 52 is elongate in shape with a narrow aspect, i.e. a height-to-width ratio and extends to a depth below the hull sufficiently to provide control of leeway forces. It will be somewhat longer than the rudder or keel of a ballasted keel yacht of the same size. The body of the foil is affixed to a shaft or pintle 126 which extends upwardly from the foil and is carried in upper and lower gudgeon bearings 128, 130 supported in a framework 132 carried in the hull between the bottom 133 and deck 134. The upper end of the pintle 126 is connected through a lever arm 314 and link 342 to the cyclic or steering helm which may be a conventional fore and aft extended tiller set on a shaft 372 connected to a cyclic steering yoke 344 to be described (see FIG. 11). A camber adjusting handle is connected to the upper end of the rod 118 for providing means for the helmsman or crew to adjust the camber of the foil (see also FIG. 11).

The foil 50, 52 are designed variable geometry to provide the large side force which they must now provide, but at a low drag cost, in the absence of a fin keel, will now be discussed. It is very important that this design is done without excessive skin (wetted) area, and with attached flows, since otherwise the profile drag contribution of the foils would be excessive upwind and downwind, thereby destroying in part, all the other drag benefits which result from the separation of functions. Low drag foils require the use of high lift devices to attain adequate lift capability with low drag downwind and high lift/drag ratio upwind.

Accordingly, in FIG. 8A, let the foil have a chord 150 and an axis of rotation located at a distance 153 from the leading edge. Distance 153 is approximately 20% of chord 150 to provide large side forces with low control forces. The flap chord is shown at 156. Chord line 157 of foil 52 is set to be collinear with chord-line 158 of the undeflected flap 114 when sailing downwind.

FIG. 8B shows that to generate a large hydrodynamic lift (side force) on the foil 52 with low drag, for example, and thereby to provide a large centripetal force or a large force normal to the hull, the foil body chord line 157 is rotated about axis 156 relative to a hull reference line 159, which is parallel to the centerline or longitudinal axis of the hull. An angle of incidence $\delta W$ is formed between 157 and 158 which determines an angle of attack relative to the water flow in the vicinity of the foil. To reduce the drag and increase the lift of foil 52, its flap 114 has been simultaneously rotated about its pivot 160 such that its flap chord 158 is inclined by an angle δF relative to the foil chord 157. δF is in the same direction as δW. The angular displacements δF and δW are not arbitrary, but correspond to a program of the shape shown in FIG. 9.

The foils for the sailing yacht should not have flaps of the chord size which is usual for aircraft wings, which is about 25% of the wing's chord, nor the usual flap deflection range, which is up to 50 degrees. On the contrary, the high lift device should be as in FIGS. 8A, 8B in which the flap chord 156 is approximately 45% of foil chord 150, and its angular deflection considerably smaller than usual, few degrees being sufficient with the large size flap for efficient upwind sailing. The large flap chord is structurally feasible because by the separation of functions as there are no ballast loads on the foils.

Figure 10:
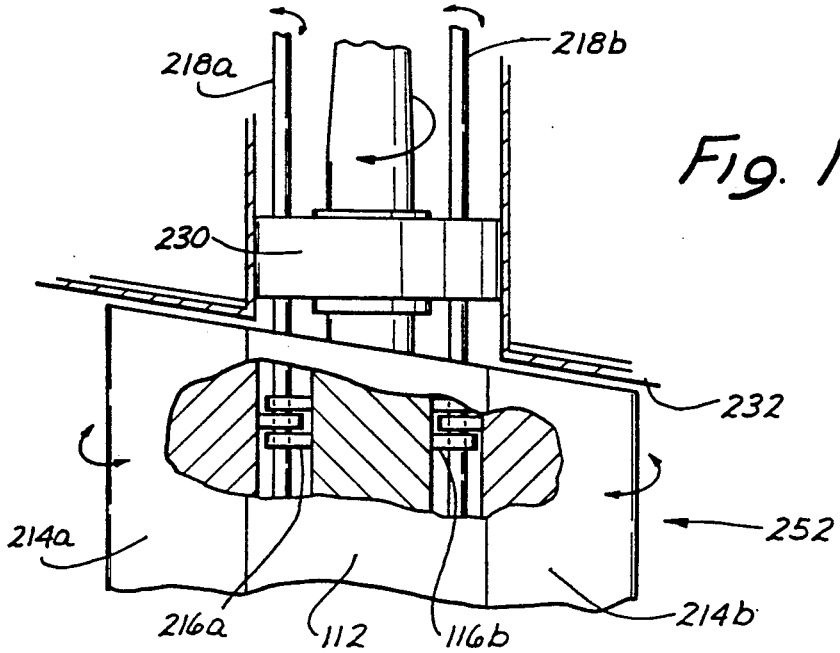
FIG. 10 is a elevational view of an alternative embodiment steering foil for use in the sailing yacht of the present invention employing an adjustable camber system utilizing both front and rear flaps.

An alternate embodiment of foil 52 is shown in FIG. 10 wherein like parts have been given like numbers raised by 100. Thus, means is provided for adjusting the foil camber which includes both an aft flap 214*a* and a fore flap 214*b* of which the aft flap is constructed similar to the aft flap 114 construction shown in FIG. 7. The fore flap 214*b* is similarly constructed in its general details as well, being hinged by hinge blocks 216*b* to the foil body 212 on a rod 216*b* for rotation about the forward hinge. The upper end of each of the control rods 218*a*, 218*b* is provided with a handle or other means for controlling the angle that each flap makes to the body of the foil. In this embodiment the foil and flaps are likewise are formed in overall section in a laminar flow shape for streamlined flow of water about the foil. Thus the flap and foil together are shaped so that the assemblage is provided with the laminar flow shape, the shape of the fore flap 214*b* being blunt by comparison with the rear flap 214*a*. The relative angles of adjustment of the flaps to the body are similar to that shown in FIG. 9, with the flaps being counter-rotated, of course, with respect to the body 212, to achieve the desired shape and camber.

Figure 11:
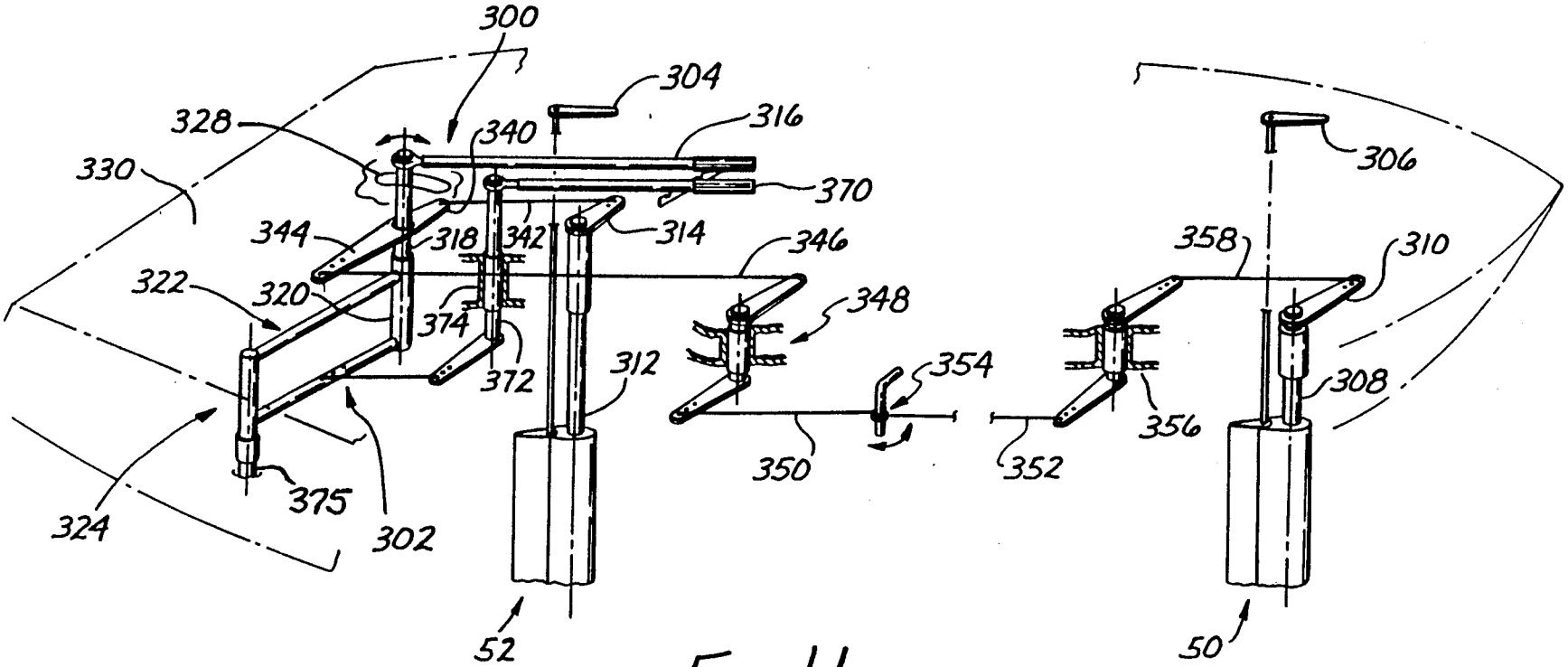
FIG. 11 is a diagrammatic view of steering linkages and camber controls of the sailing yacht of FIGS. 1-3, illustrating the cyclic and collective steering systems therein and their interconnections.
Figure 12:
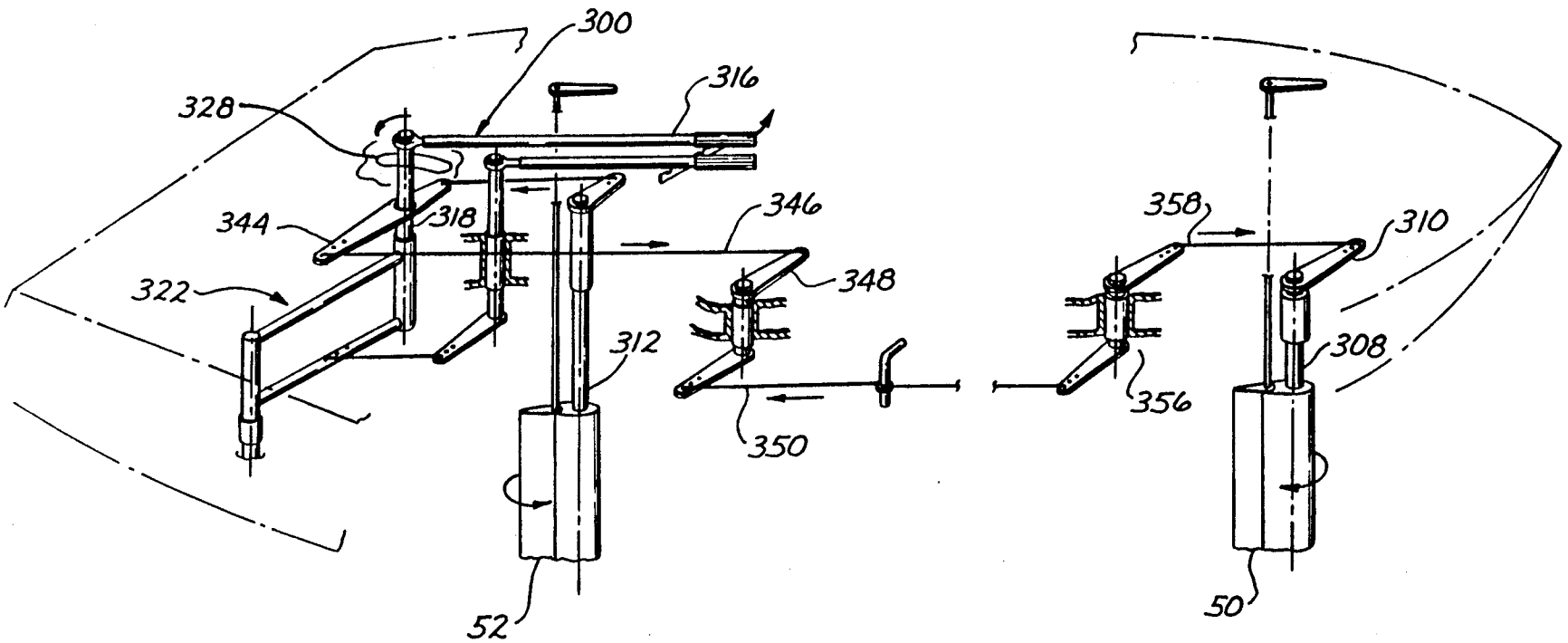
FIG. 12 is a diagrammatic view similar to that of FIG. 11 which shows the movement of the various linkage elements of the cyclic steering system in steering the yacht to starboard.
Figure 13:
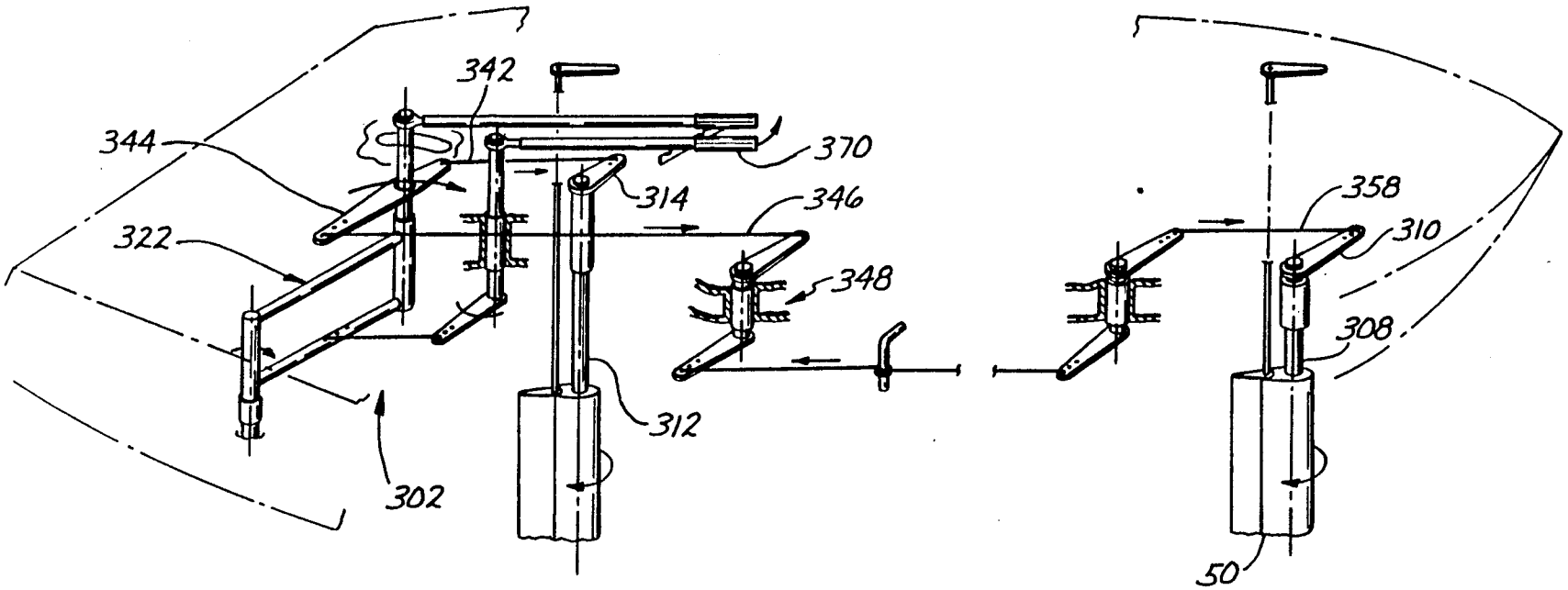
FIG. 13 is a diagrammatic view similar to that of FIG. 11 of the steering linkages of the yacht illustrating the movement of the foils as the collective steering system in rotating both foils in a clockwise sense in the same direction so as to counter leeway and bring the yacht to a specified low angle of leeway while steering a course on starboard tack, the cyclic helm remaining at a relatively balanced position amidships.

Referring now to FIGS. 11–13, the steering and collective foil control linkages are shown in diagrammatic form. The linkages comprise two systems, the cyclic steering system 300 and the collective steering system 302. Independent of these systems are camber controls 304, 306 which are shown under manual control for clarity of presentation. The cyclic and collective steering systems 300, 302 make use of many of the same mechanical parts although they are separate and distinct from each other.

The fore foil pintle 308 is rigidly connected to a transfer lever arm 310 by which the forward foil may be moved clockwise or counter-clockwise from dead ahead. Likewise, the aft foil pintle 312 is rigidly connected to a transfer lever arm 314 by which the aft foil may be moved clockwise of counter-clockwise from dead ahead. The tiller 316 and tiller shaft 318 are set in vertical bearings 320 carried on the moveable or free end of a trapeze, the other end of which is mounted for rotation on an upright pivot shaft affixed to the hull at 322 near the starboard gunwale 324 so that the free end 326 may move generally fore and aft of the yacht along an arc generally indicated by the opening 328 in the deck 330. This allows the tiller shaft 318 to move with the trapeze 322 under the control of the collective steering mechanism to be described. The tiller shaft 318 carries a port steering arm 340 connected through links 342 to the control arm 314 of the aft foil 52, and a starboard steering arm 344 connected through links 346, crank 348, motion transfer links 350, 352 crank 356 and link 358 and a toggle 354 to the control arm 310 of the forward foil 50. The links, cranks and toggle are used to mechanically transfer motion from the steering arm 344 to arm 310 over the length of the yacht in a convenient and reliable manner and offset from amidships under the gunwale at the starboard lee rail and out of the way of the crew. The arrangement of links and cranks and toggles is made sufficiently rigid that it can carry and transmit forces both in compression and tension.

As will be seen from inspection and from FIG. 12 movement of the cyclic steering tiller counter-rotates the foils, moving the aft foil 52 in the conventional direction counter to the turn while the forward foil 50 is moved into the desired turn. The ratio of movement of the forward foil 50 to that of the aft foil 52 is controlled by the ratio of the lengths of steering arm 344 to steering arm 318, and, as shown here, is arranged for a greater amount of turn to be put into the forward foil than the aft, the arms having lengths in the ratio of about 2:1.

FIG. 13 shows the operation of the collective steering system 302 which moves the trapeze 322 to change the distance between the cyclic steering shaft 320 and both pintles 308, 312 of the foils. Thus, a collective tiller 370 connects to a collective steering shaft 372 set in fixed bearings 374 mounted in the hull. The lower end of the collective steering shaft 372 is connected to the trapeze frame midway between its mounting shaft 375 and its free end by a lever arm 380 and a link 382 to move the free end thereof fore and aft as desired.

As shown in FIG. 13 the movement of the collective tiller 370 is transferred through the existing linkages equally to both of the lever arms 310, 314 connected to both of the foils 50, 52, thereby causing the foils to turn to port or starboard in unison to adjust leeway angle.

It is simplest to consider sailing the yacht of the present invention by starting on a fixed course, say a close reach. The collective tiller is set by hand so that both foils are pointing to weather by approximately equal amounts. So, if for example the true wind were 10 knots the setting might set 3 degrees on both foils pointing toward the apparent wind where the collective may be locked by a detent or notch provided on a positioning rack placed below the collective tiller. In the meantime, cyclic steering of the yacht in response to wave motion or to wind puffs is continued in the normal manner. If the wind picks up to 15 knots, the collective may be increased, say to 6 degrees, if that's what it takes to establish a true course without leeway. Accepting leeway has now become the choice of the helmsman. To tack, the collective is returned to midships, and the cyclic helm set to leeward in the regular manner. Downwind, the collective would normally be set to zero, although a sidewise skidding or crabbing movement may be achieved with the collective for special circumstances.

Figure 9:
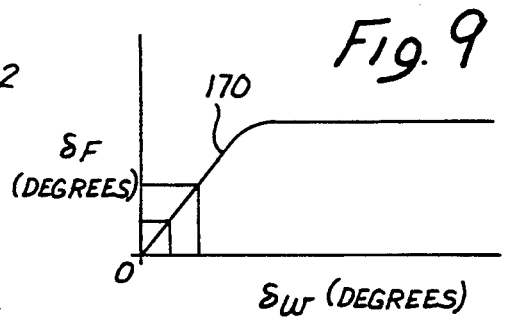
FIG. 9 is a graph showing the relationship of angle of attack for the flap ($\delta F$) to the angle of attack of the foil ($\delta W$).

As to the angle set by the collective, FIG. 8B and 9 show that the foil itself is displaced by a certain angle δF relative to the centerline of the hull. The initial deflection of the flap, δF, also starts a functional, or mechanically programmed function of deflection of the flap angle, relative to the foil. So, for example, if two degrees of foil angle are engaged, that may engage four degrees of flap.

In FIG. 9, the curve shows that for the first few degrees of foil deflection, the preferred flap deflection δF is made proportional to the foil angle to the hull and that forms the diagonal straight line 170 in the graph. There is a point, at the knee 171 of the graph, when further deflection of the flap reaches a practical limit at which it can be useful, at least without too much drag, and that flap limit is usually on the order of from five to twenty-five degrees.

Figure 14:
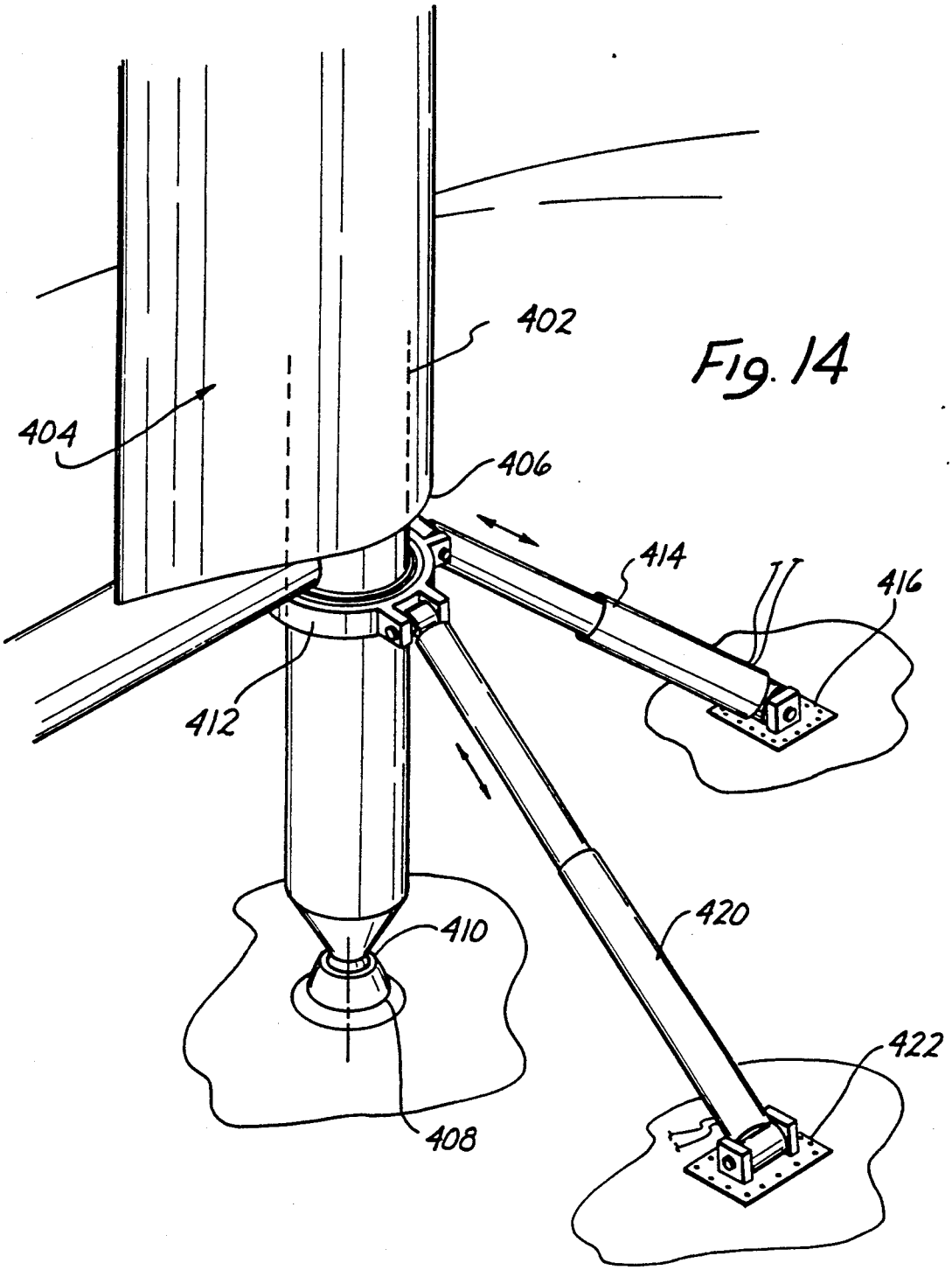
FIG. 14 is a perspective diagrammatic view of a tiltable mast mounting structure constructed in accordance with the present invention.

FIG. 14 illustrates a tiltable mast construction for the sailing yacht of the present invention in which the mast 402 is of the self-supporting type having a wing foil 404 for supporting a sail (not shown) from a mast tube 406 which extends upwardly the extent of the mast. The lower end of the mast terminates in a mounting ball 408 captured in a suitably supported deck mounted socket 410. A reinforced load distribution ring 412 is fixed to the mast tube about 2 feet off the deck. The ring 412 and mast 402 is supported fore and aft by a rake jack screw 414 connected between a deck fitting 416 and the reinforcing ring 412 for raking the mast fore and aft; and is further supported by a tilt jack screw 420 connected between ring 412 and the chain plates or other fixture 422 positioned laterally from the mast near the rail. Jack screws 414 and 420 are electrically operated to independently control the fore and aft rake of the mast as well as port and starboard tilt.

Figure 15:
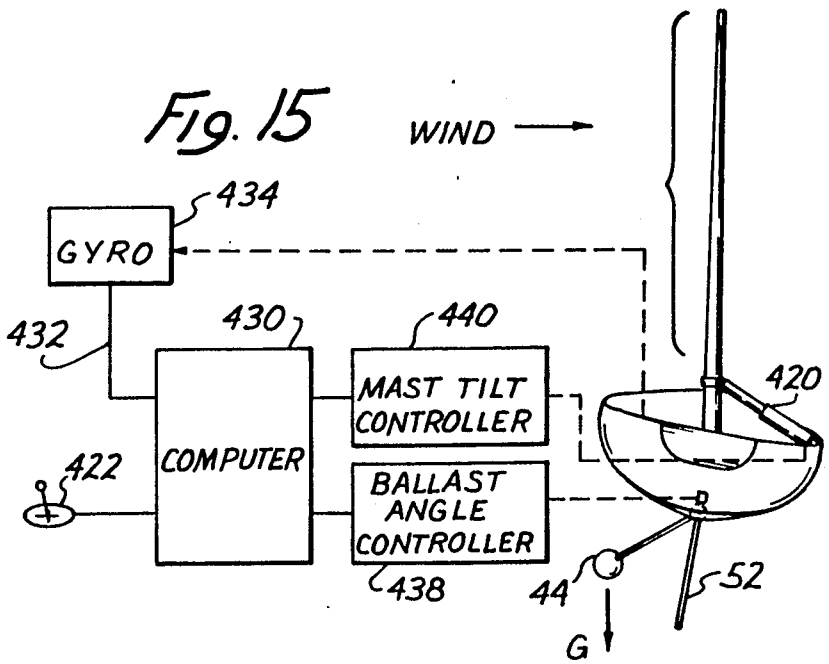
FIG. 15 is a sketch of a control system for automatically adjusting the angles of heel with the swingable ballast and the angle of mast tilt for the sailing yacht of FIGS. 1-3, and constructed in accordance with the present invention.

Referring now to FIG. 15 there is shown a sketch of the control means for synchronously operating the mast tilt control and ballast shifting control features of the yacht. Thus, having established the angle of heel desired for certain wind strength, relative wind direction, and wave considerations, which may be from test data, the results become records plotting ballast shift and mast tilt as functions of wind speed and apparent direction. These may be readily programmed into a computer 430 which receives the output 432 of a heel indicator such as a heel reference gyro 434, or a pendulum sensor mounted on board. The difference or deviation output 432 from comparing the actual angle of heel with the stored program is applied to a first controller circuit 438 for signaling the motor 80 to move the strut 46 and ballast 44, to a ballast position which decreases the difference as much as desired. Likewise, the desired tilt position of the mast is also compared to the heel indicator gyro output and actual mast position as computed from the jack screw feedback are fed back from a position indicator incorporated with the tilt jack screw 420 to the computer develop a demand signal which is applied to a mast tilt controller 440, which signals the jack screw 420 to move the mast to a more vertical position.

These features are shown as automated, but may be manually overridden or put under manual control through a separate computer input, as from a single, two-dimensional joystick 222 control input to the computer.

Figure 16:
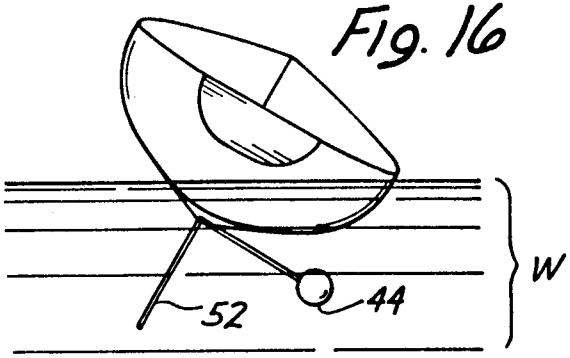
FIG. 16 is a diagrammatic sketch showing the yacht of the present invention configured for minimum draft.

Referring to FIG. 16 the yacht of the present invention is shown in an extreme position brought about by raising the ballast 44 as far to one side as possible. This lifts the foils 50, 52 somewhat and allows the yacht to assume a minimum draft in the water W, which is useful for launching or coming close to shore.

In order to better understand the advantage of a yacht constructed in accordance with the present invention some background comparison with conventional yacht design will now be given. In this discussion, the yacht of the present invention will be presumed to be going down wind, with keel positioned at the lowermost position below the hull. If going on the wind, the keel will be raised to weather, even more out of the way of the water flow beneath the yacht and past the foils so that the discussion presented will apply with even mid force.

The total hydrodynamic resistance of a sailing yacht hull can be analyzed, according to various texts and papers on yacht design, in terms of the following components of resistance:

Friction drag.
Form drag (usually included with friction).
Induced drag (due to side force).
Wave making drag (due to displacement).
Added wave drag (due to sea waves).

When the displacement yacht is sailed at speeds approaching its terminal hull speed, VH, it encounters a rapid hydrodynamic build-up principally due to an increased wave making of the hull. This drag is believed to be an inevitable physical property of a displacement type hull (as distinct from planing hulls) when moved forward through the water at a speed near VH at which the trough of its single wave is located generally near the mid-body of the hull.

The higher resistance which a heeled hull encounters upwind, compared to an upright downwind hull, is usually explained in terms of the added induced drag due to hydrodynamic side force of the fin keel and added form drag due to the non-optimum asymmetric shape of the heeled hull at a leeway angle.

However, research on the fundamental and applied hydrodynamics of sailing yachts, considered independently of traditional design approaches, and their drag explanations, have lead firstly to reevaluation of the absolute adequacy of the current designs of displacement racing hulls using a fin keel and a rudder, and secondly, to the formulation of new designs for various types of racing sailing yachts with surprising results. Before summarizing the new design features of the present invention in detail, a list is provided of the concerns had with respect to the rationale of conventional sailing yacht full design.

The fundamental hydrodynamic aspects of this investigation cover not only steady motion, but accelerated motion and includes reexamination of the physical significance for sailing yacht design of the classic parameters such as Froude number, Reynolds number, submergence depth, and virtual mass. Some of these findings are outlined below.

- hull speed VH is a convenient term of kinematic significance.
- The Froude number definition as used in naval architecture for some reason omits the water density term.
- The treatment of dynamic conditions in which virtual mass is applicable formally require an associated virtual Froude number.
- The use of the Froude number for a hull in uniform motion may be statistically significant when comparing hulls of similar configuration. However, it is not useful when applied to a completely new configuration.
- New configurations which separate side force and righting moment appendages do not have a single physically significant Froude number, but instead, Froude numbers for each component of the hull.
- Similar separation should be applied to Reynolds and Weber numbers.
- The submergence depth parameter, which in any case is apparently not formally used in naval architecture texts reviewed, is inadequate by itself to handle upwind conditions of the sailing yacht.

Drag equations which are used to estimate performance of yachts are analytically incomplete with respect to the number of drag terms in smooth water.

The complete equation for drag of a conventional sailing yacht with a fin keel and a rudder has 108 terms, the effects of which are not formally taken into account in the published equations, except in terms of empirical corrective factors evaluated from "experience". It is this experience which clouds the fundamental nature of the flow phenomena and has impeded, in the past, the correct formulation of a basic design clear of tradition.

With the respect to applied hydrodynamics, the following are of primary findings:

The addition of sea waves to an analytically complete drag equation adds formidable complexity in evaluating the effects of each drag term. However, this is no more serious, conceptually, than rough weather effects evaluated for aircraft design.

There appears to be total lack of quantitative concern with respect to accelerated motions of the hull, even though accelerated motion is the predominant mode in upwind sailing and during maneuvers, and defines the associated drag and side force flow phenomena.

The dynamics and design requirements of sailing yachts are amenable to analytic treatment in accordance to equations describing aircraft maneuvers, for example centripetal forces, damping in roll, etc.

There appears to be no experimental data pertaining to forces due to dynamic pressure of the water on appendages near the surface, either in smooth water or in sea waves.

Nevertheless, the complete analytic formulation of drag terms of the total hydrodynamic resistance of a conventional hull has been established, using aerodynamic and hydrodynamic criteria from experience in the design of aircraft, seaplanes, hydrofoils, submersibles, and submarines. This has permitted (a) reasonable estimate of the significant and the insignificant members of some of the 108 drag terms of a conventional yacht, and (b) because of its clear analytic form, it has been adequately modified with more terms, in accordance to the needs of more complex configurations, independent of tradition.

As mentioned earlier, the results of this research have been used to evaluate the properties of the most advanced conventional displacement racing hulls with a fin keel and a separate rudder, with the generally negative characteristics already mentioned.

With respect to downwind sailing, the volume of the conventional fin keel is an important contributor to wave-making resistance. That keel's adverse effect is greater than would be predictable by the square speed term related to its wetted area. Accordingly, the adequate design for the ballast should place all of its volume, but at the deepest possible depth purely for hydrodynamic wave-making reasons. This would minimize downwind surface wave making contribution generated by the volume of the ballast which otherwise is located adjacent to the most critical maximum beam stations of the hull and can interfere very adversely with the wave trough at "hull speed".

It is surprising that this hydrodynamic conclusion has not been accidentally arrived at in the past, since a deeply placed ballast body is known to improve the righting moments which are essential to generate sail thrust for upwind sailing. For example, it has not been used in highly specialized, thoroughly researched yachts of the 12-meter class. The reason is that as proposed in the past, concentrating the ballast at the bottom of a fin keel diminishes, for a given draft, the hydrodynamic span of the fin keel itself. In consequence, a new type of configuration solution is needed to meet the hydrodynamic depth requirement for the volume of the ballast, without impediment on the efficiency of side force.

For upwind sailing, the wave making resistance is further complicated by other types of phenomena: the need to generate a hydrodynamic side force by means of pressure fields generated by the conventional fin keel. This presents a formidable problem beyond induced drag and asymmetric form drag, which in the past have been perceived as the sources of added drag component of the upwind hull. There is now found to be a substantial increment of surface wave-making drag due to the interference of the low pressure side of the fin keel on the trough which exists in the windward side of the hull. This interference is due to the under-position of a low pressure field below the surface trough generated by the hull's displacement near its maximum beam position when heeled at the leeway angle. This interference further depresses the trough on the leeward side of the hull and causes an opposite effect on the windward side of the hull. Indeed, it is in this exquisitely absurd way that a fin keel boat generates its side force. However, the overall adverse interference phenomena, which is dependent on a high exponential power of an equivalent average trough (or better explained, of an increased trough on a windward side and a decreased trough on a leeward side) is, on the whole, very adverse.

According to the above analysis, the surface wave making properties of the displacement hull without a fin keel when heeled and yawed at an angle of leeway is illustrated as a baseline situation by a surface wave having a trough. The incremental effect of adding a fin keel is to add an additional trough depth, due to the flow's acceleration on top of the heeled keel at an angle of attack on the windward side of the hull. A decreased trough is simultaneously generated on the leeward side of the hull. As explained earlier, however, the overall effect, which is an exponential function of the troughs, is adverse.

The design consequences of the previous analysis of drag phenomena can be summarized in the following statements:

Downwind: less wave drag with full submergence of the ballast's volume, to maximum depth.

Upwind: less drag with no keel, since this would prevent low pressures due to side force (lift side) of the keel, which normally compounds with the trough of the wave pattern near the maximum beam, for adverse resistance effects.

Figure 17:
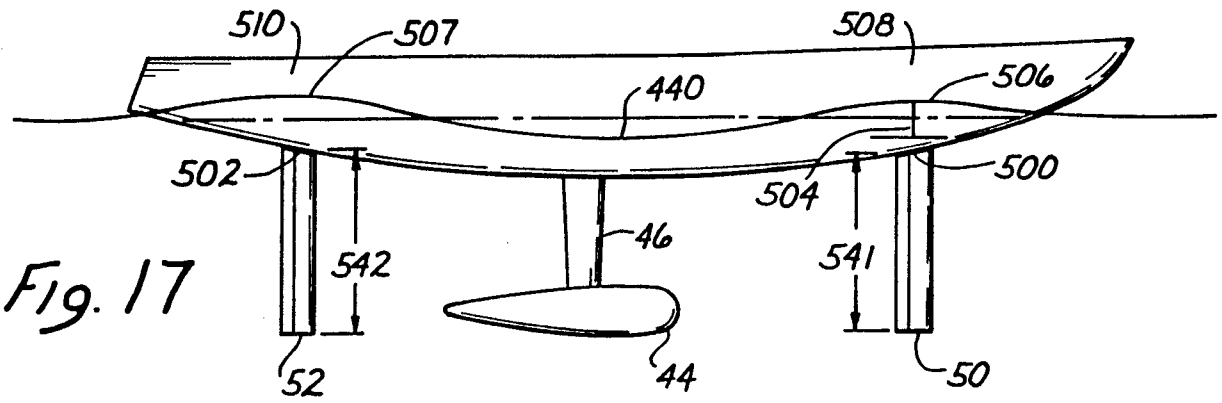
FIG. 17 is a diagrammatic sketch in elevation of the yacht of the present invention showing the bow and stern waves in relation to the various appendages.

These design principles related to reduction of wave making drag lead to the present design of a new type of displacement racing sailing yacht shown of the present invention, as illustrated in FIG. 17. The design approach here is to totally separate each of the hull's components (which operate at different total Froude numbers, different Reynold's number, separate interface depth parameters, etc.) to perform only its primary function. Accordingly, in FIG. 17:

The torpedo ballast 44 is placed with its volume at the lowest depth and lowest CG, near the mid-body hull station for low yaw moment of inertia in turns.

The hull's displacement shape should minimize its drag contribution; it is separated from the ballast appendage.

Tandem vertical foils 50 in front and 52 aft of the ballast body, and separate from it, provide directional stability, trim out side forces of sail when beating upwind, and provide centrifugal force when turning.

High lift devices (flaps) should be used on the foils to increase efficiency and so minimize foil skin area.

In the design of FIG. 17, by not having a fin keel, the adverse sub-position when sailing upwind of a low pressure field under the trough 440 generated by the hull's mid-body is eliminated. Thus, the depressing effect on trough caused by the fin keel no longer exists in the trough 440 of the present invention. Furthermore, the absence of the fin keel allows a cross-flow under the hull's mid-body, if sailing upwind at a leeway angle, and this tends to further minimize the difference of depth between the leeward and windward troughs generated by the hull. Both these effects reduce wave making drag. In consequence, the trough of the surface wave in the windward side of the hull of the present invention is much less adverse than the trough on the conventional fin keel yacht.

The above described benefits in wave making are important hydrodynamic results of (a) separating the side force function from the ballast function, (b) providing a streamlined ballast supported separately and away from the hull by a narrow strut 46 which is preferably a single fin having only so much fore and aft extent as is necessary to support the ballast and (c) providing a pair of front and rear foils 22 and 52, separate from the ballast appendage.

The rear foil 52 is preferably supported on the hull upstream of its wetted smooth under-stern on an approximately vertical axis, so that foil 52 can pivot right or left. Similarly, front foil 50 is supported at an axis, about which it can pivot right or left. This type of support by which the foils are not fixed but are moveable separate from the hull is structurally feasible because the weight of the ballast is not supported by the foils, by virtue of the separation of functions. Thus, the structural separation from the ballast support permits the use of slender foils with variable camber high lift elevation plans. The foil's structural separation from the hull by an axis which permits rotation of the entire foil relative to the hull and eliminates the need for leeway angle on the hull as a way to generate a side force from the side force appendage.

The hydrodynamic control of the hull of this invention is accomplished as follows: For maximum centrifugal acceleration, both foils are turned on their axes in the same angular direction. For yawing into a turn, the front foil above may be used. For maximum yawing moments, for example, in turns during competition, both foils are turned on their axis, but in opposite angular direction.

Important hydrodynamic parameters and design characteristics of the keelless twin foil design are shown in FIG. 17. There is a much more efficient hydrodynamic span of foils 50 and 52, greater than prior geometric spans, since the roots of the foils at 500, 502, are far removed from the water surface and protected from the surface effects by a local hull umbrella. The induced drag efficiency is very good. As a result of the separation of functions, there is also a reduced amplitude 504 of the wave making of hull, the mid-body of which is free of adverse drag interference effects of the fin keel. The reduction of resistance results in a vastly improved upwind performance.

A new important design feature is shown in FIG. 17, pertaining to special location of the roots 50*a* and 50*b* of the foils 50 and 52 in unique cooperation with (a) the front and rear crests 506 and 507 of the wave at the hull's forward section 508 and the hull's rearward section 510, and with (b) the shallow local draft of hull ends, at the stations where the roots of the foils are placed, compared to the usual mid-hull draft, which severely limits the draft of the fin keel and its span efficiency.

The new configuration and large span for the side force appendages, made possible by eliminating the fin keel, converges as a design feature with the general equation for induced drag Di of lifting wings. This equation states that the induced drag is inversely proportional to the square of the effective aerodynamic span in the following manner:

$$Di=f(F,b,q,e)$$

where f() is a function of the listed variables, namely, and

F=side force (usually to the second power, $F^2$), b=effective span (usually inverse second power, $1/b^2$)

q=dynamic pressure e=efficiency factor

To maximize the effective span, the present new design takes advantage of the shapes of the wave crests and of the slopes of the hull's fore-body and rear-body, to provide a maximum geometric span 541 and 542 for the front foil 50 and rear foil 52, respectively. For the rear foil, dimension 542 is also made larger by the elimination of the conventional bustle. The geometric span of the foils is evidently of a much larger magnitude than the geometric and hydrodynamic spans and of the rudder and fin keel of the conventional sail yacht body. Since the effective hydrodynamic span, b, of the foils in FIG. 17 is larger than their geometric spans, their effectiveness in reducing induced drag Di, which varies inversely with the effective span squared, and is very great, compared to a conventional design.

To attain the effective hydrodynamic spans of FIG. 17, however, it is necessary to retain sufficient depth of steady water protection above roots 534 and 535 of the foil including some hull umbrella protection when heeled. Hence, the longitudinal position (fore and aft) of the foils should not be too close to the extreme ends of the static or sailing water line lengths. Furthermore, allowance should also be made for the boat's pitching which would tend to ventilate the roots of the foils when beating upwind in a heavy sea, if placed too close to the waterline ends. The ballast 44 can have a circular cross-section for minimum skin area and low viscous drag. An elliptic cross-section alternative adds skin area but for a given draft also lowers somewhat its center of volume and gravity.

With the yacht design of the present invention, which separates the side force and ballast function, it is possible to use a forward sail plan position such to engage the proper interaction of sail aerodynamic load and foil hydrodynamic loads, without the hydrostatic nose down pitch due to a forward ballast location of conventional design, since the ballast need not be placed forward for considerations of leeway control. In fact, the ballast in the present invention can trim out, by a slight rear displacement, the forward weight of a more forward mast position.

Yet another benefit of separating the side force and ballast functions, occurs with respect to waisting the mid-hull to decrease wave making drag on the hull. Waisting the hull has been proposed in the past as a way to reduce the adverse effects of longitudinal volume distribution of a hull with a fin keel. With the present design however, the fin keel is eliminated, and the volume distribution of a standard hull is no longer additive with that of the ballast appendage. In consequence, a waisted hull need not be designed to minimize the adverse interference of the volume of a conventional fin keel with the hull, but instead, to minimize the wave making drag of the hull itself. The present ballast is now separate from the foils and will not impede upwind the hull's waisting benefits with an adverse pressure field from the side force appendages.

The present design further incorporates the features that the ballast appendage can be tilted such that the boat remains without any significant heel to keep maximum sail thrust with minimum induced drag and viscous drag from the submerged foils, which generate the side forces against leeway from efficient cambered surfaces.

By tilting the strut to one side, the flow aft of the forward foil is not impinging on anything by way of a ballast body, it is free to flow backwards all the way to the rear foil, and this combined foils are able to engage a body of flow undisturbed by any ballast. The foils form a cantilevered biplane, by analogy, which is extremely efficient hydrodynamic way to generate side forces to oppose the sail's contrary side force with a minimum vortex or induced drag underwater. Having totally separated the functions and having now two variable orientations foils in this design, a leeway angle is no longer needed to define an angle of attack against the water. Having done that, the fixed restraints of geometry are released; the sails are released from the obedience to that component of the apparent wind angle is set by leeway. Now the yacht sails on two sets of sails, aerodynamic sails above water and the hydrodynamic sails underwater, in which optimum combination for the apparent wind and water angles, the course, and wave conditions.

Improved hull shapes for yachts taking advantage of the principles of this invention are disclosed in the three embodiments shown in FIGS. 18 to 25. In each, there is provided a lower hull which intersects and joins an upper hull along one of the waterline curves of the yacht. For convenience, the upper hull portion and the lower hull portion will hereinafter be referred to as the upper hull and the lower hull respectively. The lower hull sections are semi-circular in section and laterally converge inward toward the bow with a decreasing radius, in section, so as to generally lie on the surface of a right circular conical form.

The upper hulls are formed with portions having lateral extent greater than that of the lower hull for increased stability when heeled. The upper and lower hulls merge at one of the waterlines of the yacht. In the drawings, the ballast and foil appendages are not shown in FIGS. 18–19, and 23–25 for clarity of illustration.

Figure 18:
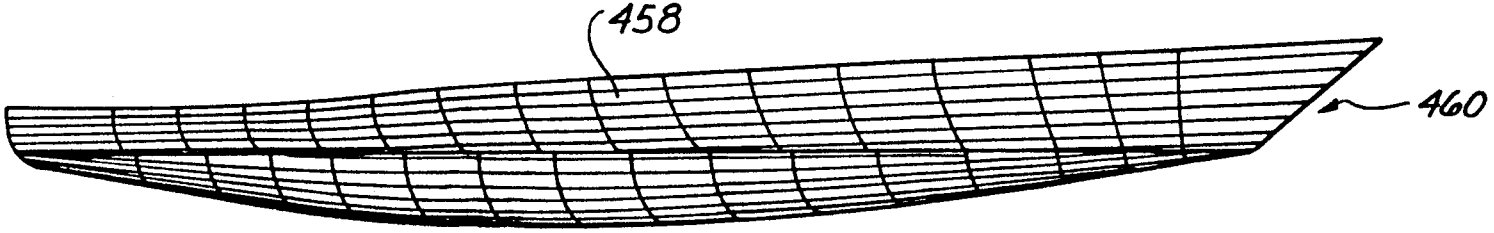
FIG. 18 is a perspective model of an improved duplex mono-hull form of a yacht constructed in accordance with the present invention, with strut, ballast, and foils removed for clarity of illustration.
Figure 19:
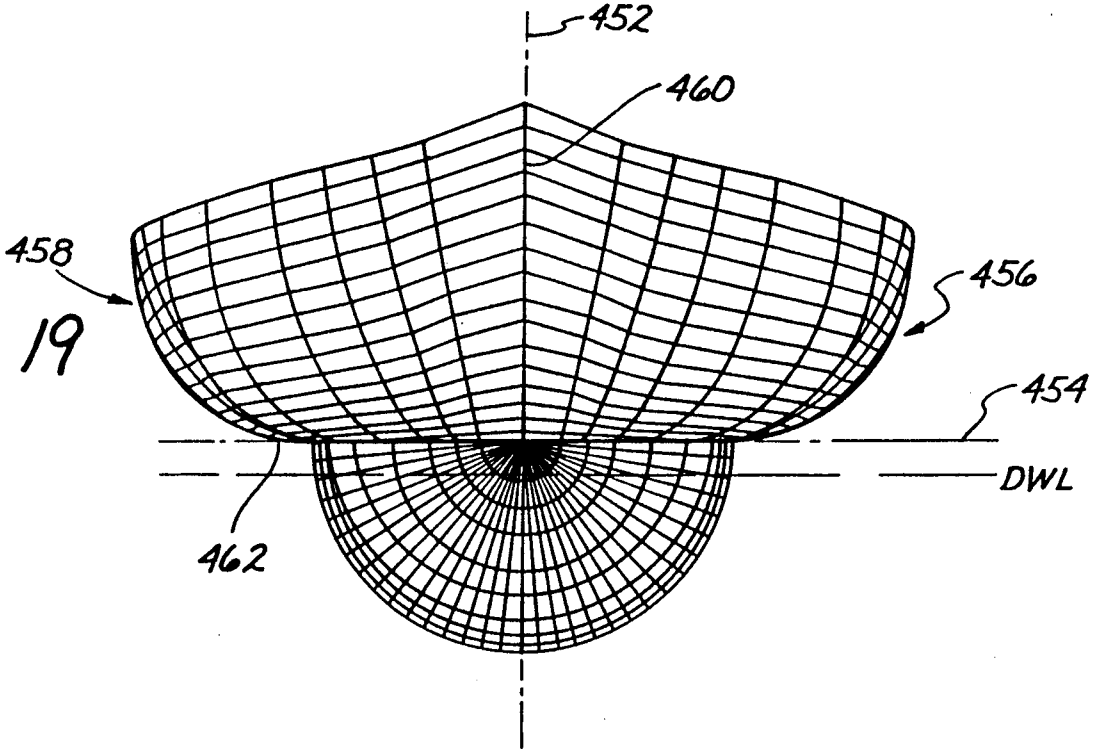
FIG. 19 is a bow on view of the hull form of FIG. 18.

Thus, in FIGS. 18 and 19, the upper hull is generally bulbous in shape, curving and inward toward the midplane 452 as it merges into and joins the lower hull at waterline 454. The upper hull 450 forms topsides 456, 458 for the yacht that generally lie along a circular form at the turn of the bilge at midships section and are substantially larger in lateral extent than the lower hull. The upper hull converges with increasing radius toward the bow 460. The effect is to produce an outwardly flared wing-like transition 462 around the yacht for additional buoyancy when desired for in port operations, and the like, as well as for additional accommodation space.

Thus the upper hull shape commences contact with the water at an angle of heel which is estimated to be about 20 degrees of heel to provide additional stability for sailing or when moored, and can be achieved by ballasting.

Figure 20:
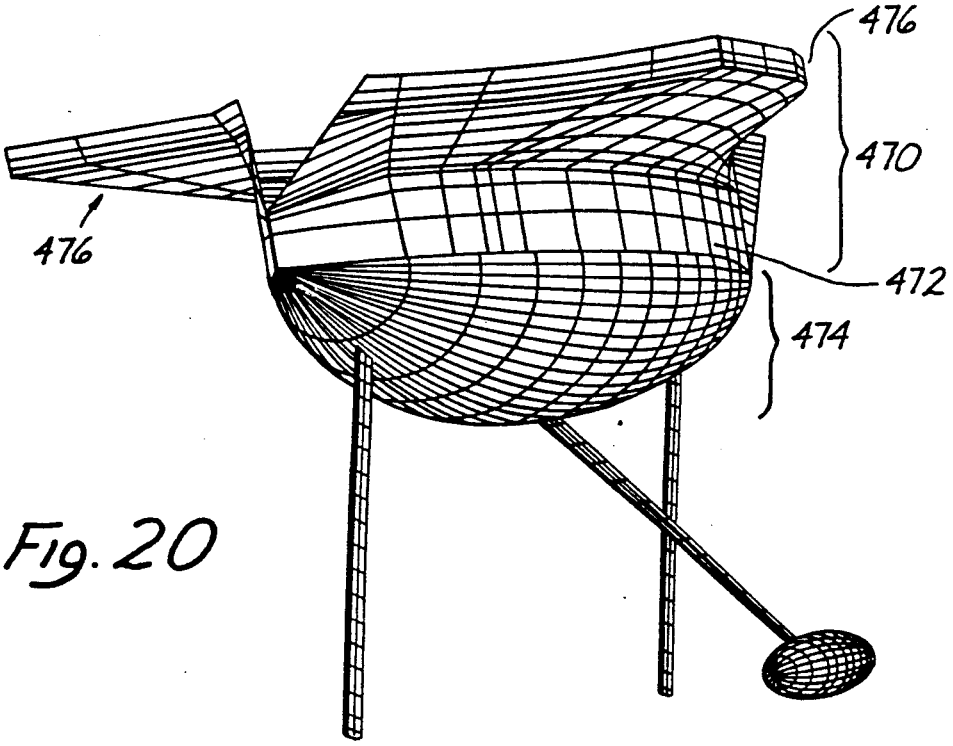
FIG. 20 is a perspective view, taken from the starboard quarter, of another improved hull form for a yacht constructed in accordance with the present invention.
Figure 21:
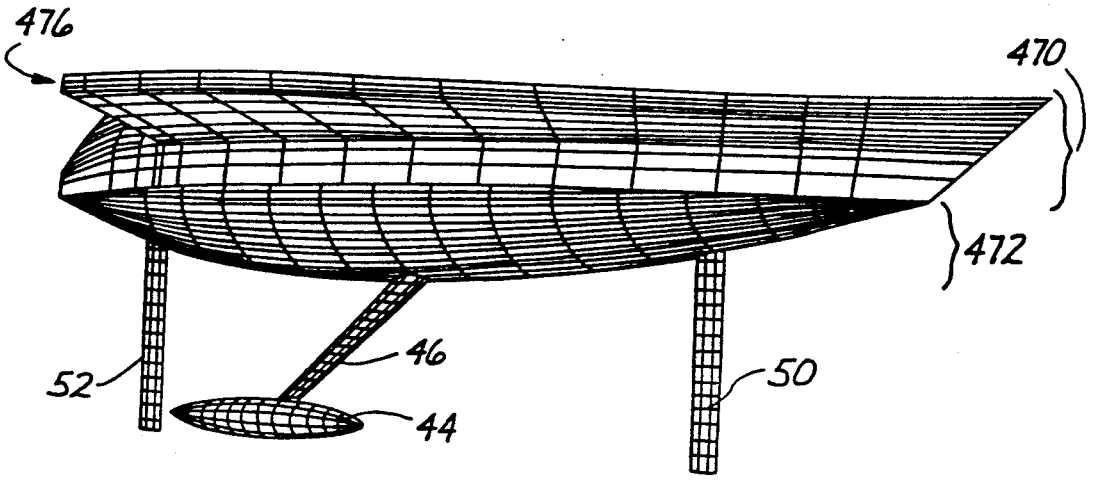
FIG. 21 is a view taken forward of the starboard beam of the yacht of FIG. 20.
Figure 22:
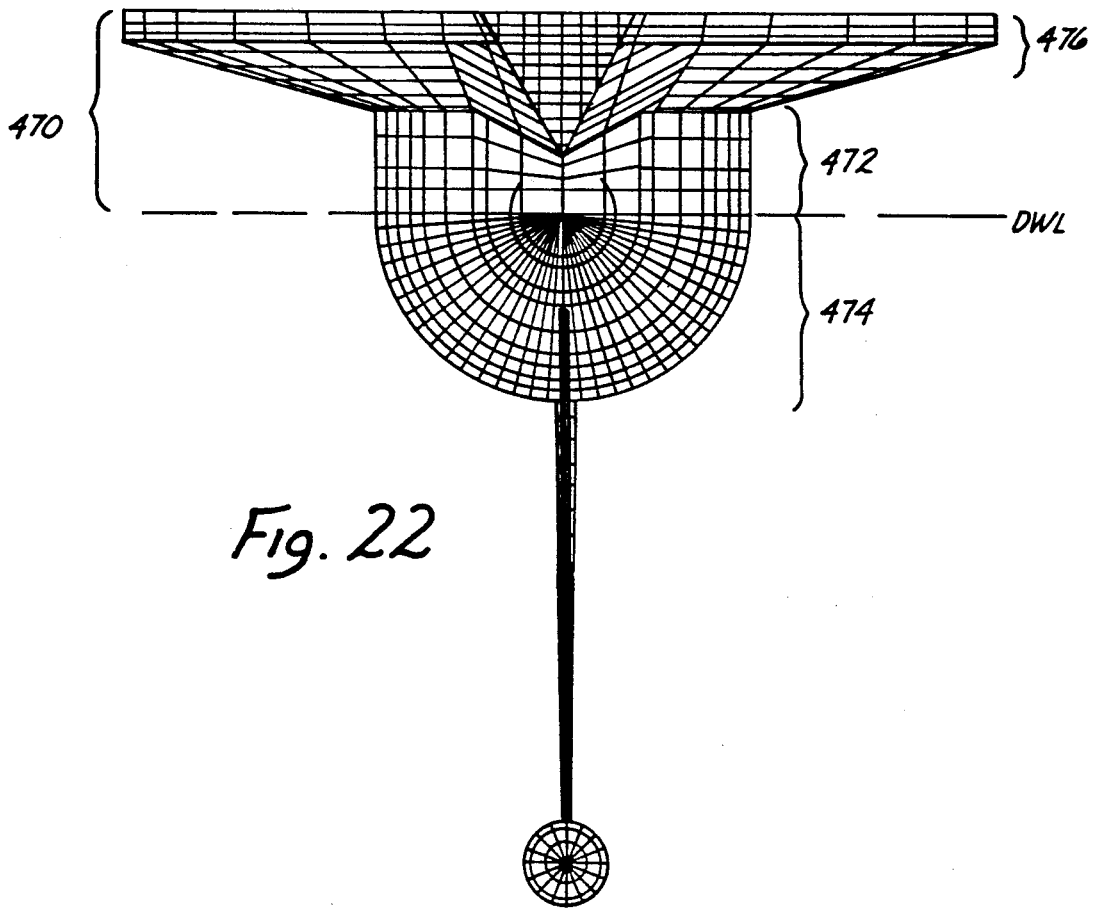
FIG. 22 is a elevational bow-on view of the yacht of FIG. 20.

Referring now to FIG. 20–22, there is shown a further development of the duplex mono hull sailing yacht in which the upper hull 470 is developed with a vertical topside transition 472 to the lower hull 474 which is itself shaped as previously explained. The upper part of the upper hull 470 flares into wings 476 extending laterally about the hull and tapering down toward the bow. The wings serve a similar purpose of reserve stability and a platform for crew operations, as may be desired.

In these hull forms wherein the lower hull is semi-circular form in section with a hull design waterline (D.W.L.) lying in the lower hull, the combination of lowest wetted surface and outstanding strength is achieved, so that lightness of construction may be obtained in a very fast hull form. At the waterline transition, where the upper hull flares from the basic shape of the lower hull, there is created a partial planing surface for downwind sailing in a good breeze.

Figure 23:
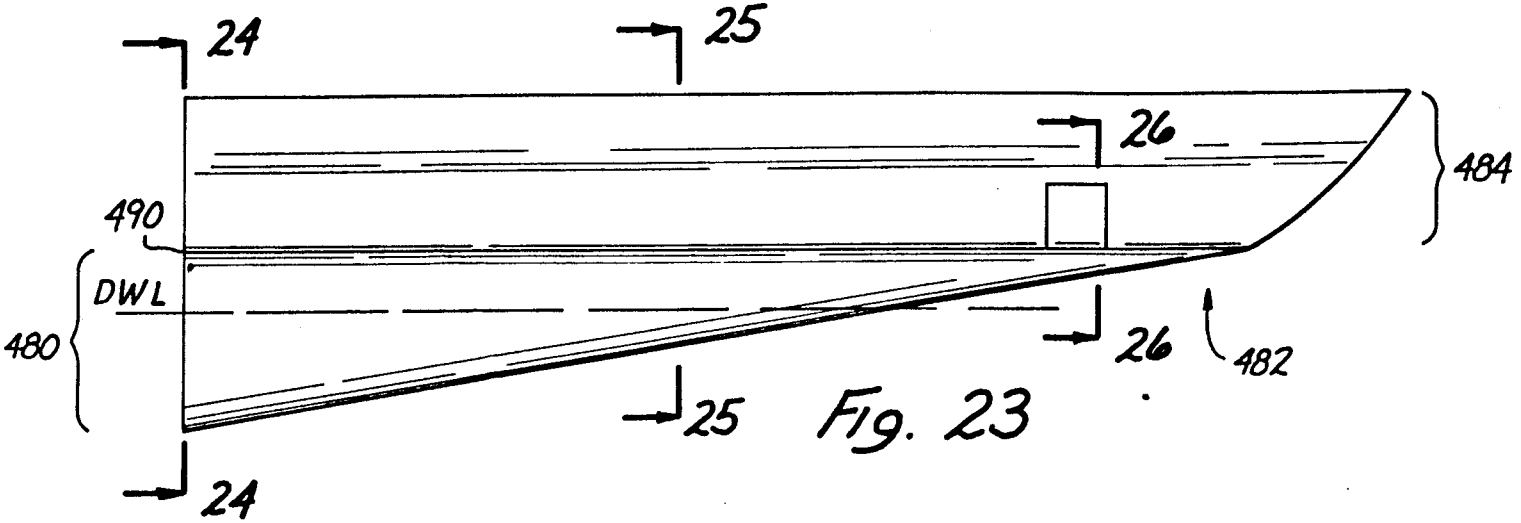
FIG. 23 is a side elevational view of the forward part of another improved hull form of a yacht constructed in accordance with the present invention.
Figure 25:
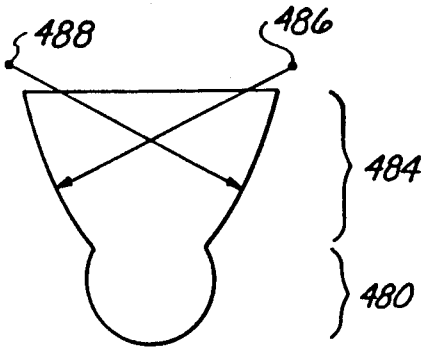
FIG. 25 is a cross-sectional view of the yacht of FIG. 23 taken along the lines 25—25 thereof.
Figure 24:
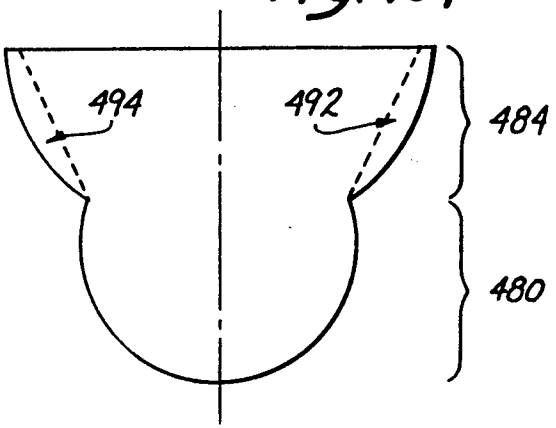
FIG. 24 is a cross-sectional view of the yacht of FIG. 23 taken along the lines 24—24 thereof.

Referring now to FIGS. 23–25, there is shown another embodiment which further develops the hull form concepts so far disclosed. Thus, the lower hull 480 is of generally conical form as it converging toward the bow 482 (and the stern, not shown), as has been described. The upper hull 484 is less extreme than in prior examples, having a partially circular form at the midsection and converging toward the form at the midsection and converges toward the bow 482 while maintaining the same radius of curvature, but located on different, overlapped centers 486, 488, as shown in FIG. 25.

Thus, the upper hull may be described as formed of two sections or shell forms taken from a right circular cylinder wherein the radius of curvature is constant. The sailing waterline is approximately in the middle of the lower hull in height at the midsection. The upper and lower hulls intersect along one of the waterlines as shown in FIG. 23 at 490 which becomes a load waterline (L.W.L.) when additional ballast to be described is added.

Both port and starboard ballast tanks 492, 494 and bow and stern ballast tanks are provided for adjusting the relative buoyancy of the yacht and for raising the yacht to the first waterline (D.W.L.) for faster sailing. Alternatively, the yacht can be lowered to the second waterline (L.W.L.) for greater stability and comfort in port and possibly for downwind planing. Of course, by deploying the lateral buoyancy ballast tanks, additional counter-heeling forces may be added for windward work.

FIG. 26 shows the forebody of a yacht similar to that of FIGS. 23 through 25 in which bow wings 600, 602 have been added to provide several stabilizing features in the performance of the yacht. Thus each bow wing consists of a strong flap mounted to a hinge 606 aligned fore and aft on an arbitrary waterline of the hull such as the load waterline. The flaps preferably take the shape of a curved shell conforming to that of the shape of the hull immediately above the hinge so that each flap will lie flush with the hull when retracted. Actuators 610 are mounted inside the hull and is provided with actuator arms 612 extending through the hull and connected to the flap at a distance from the hinge, so that extension of the actuator arm opens the flap away from the hull to lie in a generally horizontal position as shown in phantom lines at 614.

Referring now to FIG. 27 an alternate mast support and tilting mechanism is disclosed wherein a deck reinforcing plate 640 is secured to the deck 642 and to a supporting bulkhead (not shown). The plate 640 carries a bearing block 644 at deck level oriented fore and aft on the centerline of the yacht. A mast 646 is provided which extends through the deck and into the interior of the hull. The mast load is carried on a shaft 650 integrally formed into the mast and aligned fore and aft for resting in the bearing block where it is captured by bearing caps (not shown). The lower end of the mast is movable to port and starboard and is carried laterally by a cable drive 654 provided in the hull. Thus fixed port and starboard pulleys 656, 658 are mounted to a bulkhead (not shown) for support, and carry a belt 660 upper and lower trains. The lower train of the cable engages a drive pulley 662 of a motor 664 suitably mounted, while the upper train between the pulleys is secured to the bottom end 652 of the mast. The motor may be an electrically driven type to move the upper train of the cable so as to carry the lower end of the mast to any desired tilt angle within the range of the limits of travel between the pulleys. This is more than adequate for the mast tilting requirements of the yacht of the present invention. A hydraulic piston or gear drive system is an alternative for mast tilting.

Figure 28:
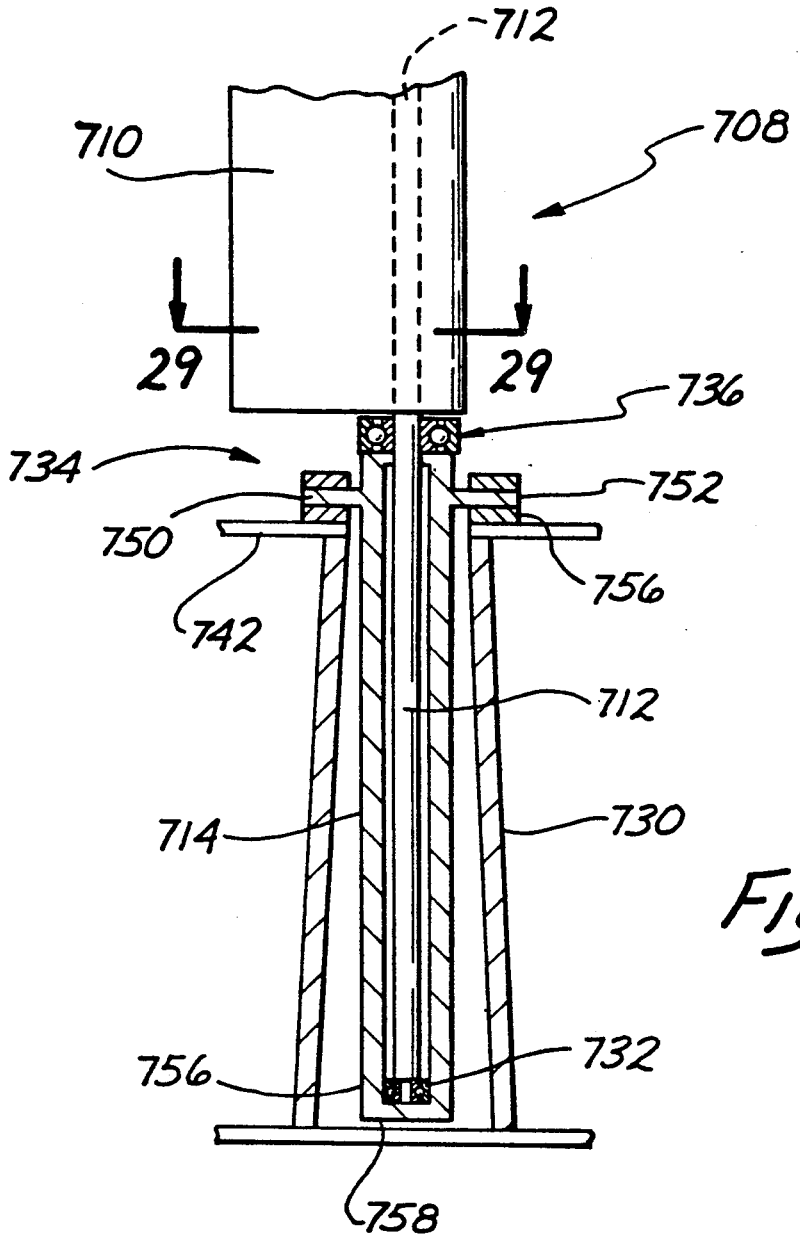
FIG. 28 is a side elevational view partly in section through a alternate construction of a sailing yacht mast tilt system, similar to that of FIG. 27, which provides a rotatable and tilting mast with aero-dynamic cross-section, constructed in accordance with the present invention.
Figure 29:
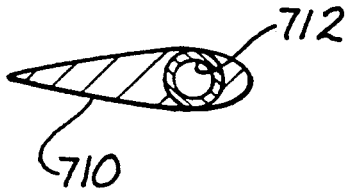
FIG. 29 is a cross-sectional view taken along the lines 29—29 of FIG. 28.

Referring now to FIGS. 28 and 29, there is shown an alternate embodiment of the tilting mast structure of FIG. 27 in which the additional feature of rotatability of the mast has been incorporated. Thus, there is now added, in combination with the tilting feature, a rotatable mast 708 having a leading edge aerofoil 710 of aerodynamic streamlined cross-sectional shape which is supported on a strong stainless steel mast tube 712 which passes through a tilting bearing 740 and extends below the deck into a mast support tube 714.

The support tube 714 has journal shafts 750, 752 extending laterally and exteriorly from each side at its upper end 734 for resting in a bearing block 756 mounted on deck in alignment with the fore and aft axis for allowing tilting movement of the mast±20 degrees. The bearing block 756, mast 708, and sails are supported by additional support framework 730 within the hull. The inner mast tube 712 may be made of stainless steel or other strong metal tubing or of aerospace composite and is set into a ball bearing 732 encircling the inner mast tube 712 and positioned at the bottom of support tube 714 for lateral and axial support so that mast tube 712 may freely rotate therein. The upper end 734 of the mast support tube carries second ball bearing 736 for carrying both axial and lateral loads so that the mast is securely held within the tube 714 for rotation and against axial movement.

The bottom end 758 of the mast tube is attached to a cable, such as 660, and its movement mechanism, as shown in detail in FIG. 27, for tilting of the mast support tube 714 and mast 708.

Rotation of the mast and its aerofoil leading edge under wind pressure allows the shape of the luff the sail to assume an optimized shape for the particular wind angle on the point of sailing relative to the position of the boom, so that mast turbulence and eddies are reduced to a minimum.

In the embodiment shown, the aerofoil is free to turn in response to wind pressure, but may be made mechanically adjustable to be set to a specific angle, by the addition of crank and screw adjustment, if desired.

To those skilled in the art to which the invention pertains, many modifications and improvements will occur. Some of these have been discussed. Another example concerns the shape of the front foil 43 which may be sloped or swept backwards in due respect to the presence, in real seas, of seaweed, logs, etc., which a sweptback surface can push aside with relative ease. In consequence, the foil position and the planforms shown in FIG. 17 embodies characteristics for a good practical design in real sea conditions. Other improvements will also occur and should be understood to be within the spirit and scope of this invention, which is only to be limited by the following claims.

What is claimed is:

1. A sailing yacht comprising a sailing hull having a bow and a stern extending along a centerline at midships, and having port and starboard sides, and a mast, comprising:

a ballast, an elongated strut having one end connected to said ballast for supporting the same, means for mounting said strut to depend from said hull for supporting said ballast generally below said hull for countering heeling thereof under sail and for providing movement of said strut about an axis lying fore and aft on said centerline, means connected to said strut for shifting said ballast to port or to starboard from a generally mid position and for securing said ballast at any position therebetween while said yacht is underway, fore and aft foils mounted for rotation about axes extending below said hull fore and aft of said strut and ballast, a first control means connected to said foils for counter rotation thereof for cyclic steering by turning said foils in opposite directions to port or starboard for creating a yawing moment for steering said yacht on its course, a second control means connected to said foils for turning said foils in the same direction for collective steering, each of said first and second control means being operable independently from the operation of the other.

2. A sailing yacht comprising a sailing hull having a bow and a stern extending along a centerline at midships, and having port and starboard sides, said yacht having mast and sails, and responsive to wind for developing forward thrust for moving said yacht along its course and a side thrust tending to heel said yacht to leeward from vertical, a ballast, an elongated strut having one end connected to said ballast for supporting the same, means for mounting said strut to depend from said hull for supporting said ballast generally below said hull for countering heeling thereof under sail and for providing movement of said strut about an axis lying fore and aft on said centerline means connected to said strut for shifting said ballast to port or to starboard from a generally mid position and for securing said ballast at any position therebetween while said yacht is underway, fore and aft foils mounted for rotation about axes extending below said hull fore and aft of said strut and ballast, means for turning said foils in opposite directions to port or starboard for creating a yawing moment for steering said yacht, a mast, bearing means for supporting the mast at the hull and for providing supported angular movement thereat, means for angularly moving said mast in said bearing means to bring the top of the mast to port or to starboard by an amount which returns the mast to windward toward or beyond vertical when said yacht is heeled.

3. A sailing yacht comprising a sailing hull having a bow and a stern extending along a centerline at midships, and with port and starboard sides, and a mast, a ballast, an elongated strut having one end connected to said ballast for supporting the same, means including a shaft for mounting said strut to depend from said hull for supporting said ballast generally below said hull for countering heeling thereof under sail and for providing movement of said strut about an axis lying fore and aft on said centerline, means connected to said strut for shifting said ballast to port or to starboard from a generally mid position and for securing said ballast at any position therebetween while said yacht is underway, said means for shifting said ballast including a yoke having port and starboard yoke arms extending downwardly, port and starboard pulleys carried on said yoke arms respectively, a drive pulley mounted to said yoke, said port, starboard, and drive pulleys being aligned in a common plane, a linkage trained around said pulleys, said strut extending upwardly from said shaft, means for connecting the upper end of said strut to said linkage for being carried port and starboard therewith in response to rotation of said drive pulley, fore and aft steering foils mounted for rotation about axes extending below said hull fore and aft of said strut and ballast, and means for turning said foils in opposite directions to port or starboard for creating a yawing moment for cyclic steering of said yacht.

4. A sailing yacht comprising a sailing hull having a bow and a stern extending along a centerline at midships, and having port and starboard sides, said hull having lower and upper portions, said hull portions being merged at one of the waterlines of said yacht, said lower hull portion having sections that lie on a generally circular shape and which laterally converge toward the bow, and said upper hull portion having a lateral extent greater than that of said lower hull portion for increased stability when heeled, and for assisting said hull toward planing under appropriate conditions, said upper hull portion forming topsides for said yacht that lie on a generally circular shape in the turn of the bilge at the midsection of the hull, a mast, solid ballast, an elongated strut having one end connected to said ballast for supporting the same, means for mounting said strut to depend from said hull for supporting said ballast generally below said hull for countering heeling thereof under sail and for providing movement of said strut about an axis lying fore and aft on said centerline, means connected to said strut for shifting said ballast to port or to starboard from a generally mid position and for securing said ballast at any position therebetween while said yacht is underway, fore and aft steering foils mounted for rotation about axes extending below said hull fore and aft of said strut and ballast, and means for turning said foils in opposite directions to port or starboard for creating a yawing moment for steering said yacht.

5. A sailing yacht comprising a sailing hull including port and starboard sides, a bow and stern, and a mast, a solid ballast, an elongated strut having one end connected to said ballast for supporting the same, means for mounting said strut to depend from said hull for supporting said ballast generally below said hull for countering heeling thereof under sail, fore and aft steering foils mounted for rotation below said hull fore and aft of said ballast and generally near the bow and stern waves of said yacht, and means for turning said foils in opposite directions to port or starboard for creating a yawing moment for steering said yacht, means for turning said foils in the same direction to port or starboard for controlling the leeway of said yacht, a steering station including a main helm, a first steering means connected between said main helm and said means for turning said foils in opposite directions for counter rotation thereof for cyclic steering and turning of the yacht on its course, a second helm at the steering station, a second steering means connected between said second helm and means for turning said foils in the same direction for collective steering.

6. In a sailing yacht including a sailing hull having a bow, a stern, a mast, and a solid ballast, the improvements comprising:

means for supporting said ballast generally below said hull for countering heeling thereof under sail, said last named means having no necessary control over the leeway of said yacht and insignificant with respect to leeway, when canted, fore and aft steering foils mounted for rotation about vertical axes lying in the midplane and extending below said hull fore and aft of said ballast, first control means for turning said foils in opposite directions to port or starboard for creating a yawing moment for steering said yacht, second control means for turning said foils in the same direction to port or starboard for controlling the leeway of said yacht, a steering station, first steering means connected between said steering station and said means for turning said foils in opposite directions for counter rotation thereof for cyclic steering and turning of the yacht on its course, second steering means connected between said steering station and said means for turning said foils in the same direction for collective steering, said first and second steering means being constructed and arranged for operation independent of each other.

7. A sailing yacht comprising a hull, mast and at least one sail, said hull having port and starboard sides, said hull, when moving over a body of water, causing bow and stern waves to develop fore and aft of a trough formed at the midbody of said hull, and further subjected to a heeling force and leeway from the action of wind on sail, a solid ballast, strut means for mounting said ballast to depend from said hull generally at said midbody, said strut means and said ballast having no necessary control over the leeway of said yacht as had been formerly assigned to a keel, means for mounting and for moving said strut means and ballast to port or to starboard to counter said heeling force, fore and aft foils mounted to depend from said hull, extending downwardly and generally into said bow and stern waves, said foils being constructed and arranged to provide the principal resistance to leeway for said yacht, first control means for turning said foils in opposite directions to port or starboard for creating a yawing moment with respect to each other for steering said yacht, and second control means for turning said foils in the same direction to port or starboard for adjusting the leeway made by said yacht, and means for independently operating said first and second control means.

8. The sailing yacht as in claim 7 wherein:

said ballast is shaped as a streamlined torpedo, and further wherein:

said strut means is a single fin with only so much fore and aft extent as is necessary to support said ballast.

9. The sailing yacht as in claim 7 further including a main helm for steering, steering means connected between said main helm and said first control means for counter rotation for cyclic steering and turning of the yacht on its course.

10. The sailing yacht as in claim 9 further including a second helm, second steering means connected between said second helm and said second control means for turning said foils in the same direction for collective steering of said yacht.

11. The sailing yacht as in claim 7 further including a main helm for steering, steering means connected between said main helm and said foils for counter rotation for cyclic turning and steering of the yacht on its course, a second helm, a second steering means connected between said second helm and said second control means for turning said foils in the same direction for collective steering.

12. The sailing yacht as in claim 7 wherein said foils are hydrodynamically shaped with a high aspect ratio.

13. The sailing yacht as in claim 7 further in which at least one of said foils further includes means for changing the camber thereof, and means adjusting the camber of said foil while underway.

14. The sailing yacht as in claim 13 wherein said foil includes a main body, and wherein means for changing the camber comprises an adjustable flap mounted from the aft portion of said main body.

15. The sailing yacht as in claim 13 wherein at least one of said foils includes a main body, and an adjustable flap mounted from the aft portion of said main body, and a second adjustable flap mounted from the forward portion of said body.

16. The sailing yacht as in claim 13 wherein the camber is adjustable up to 25 degrees.

17. The sailing yacht as in claim 7 further including means for mounting said mast at the midplane of said hull, and means for tilting said mast to port or to starboard about a centerline of said hull.

18. The sailing yacht as in claim 17 further including means for generating a tilt demand signal representing the desired angle of said mast, means responsive to said tilt demand signal for moving said mast toward or beyond vertical in response thereto.

19. The sailing yacht as in claim 17 further including means for sensing angle of heel of said yacht, means for generating a demand signal representing the desired angle of heel, and means responsive to said demand signal for shifting said ballast to windward to counter said heeling movement by the demanded amount, means for generating a tilt demand signal representing the desired angle of said mast, means responsive to said tilt demand signal for moving said mast toward or beyond vertical in response thereto.

20. The sailing yacht as in claim 19 further in which said hull comprises a lower hull, and an upper hull having a lateral extent greater than that of said lower hull and converging toward said lower hull along an outwardly flared portion thereof on which said yacht can plane and which provides for increased stability when heeled, said upper and lower hulls being merged along one of the waterlines of said yacht.

21. The sailing yacht as in claim 7 further including a bearing for supporting the mast at the hull and for providing supported angular movement thereat, means for angularly moving said mast in said bearing to bring the top of the mast to port or to starboard by an amount which returns the mast toward or beyond vertical when said yacht is heeled.

22. The sailing yacht as in claim 7 further in which said hull comprises a lower hull, and an upper hull having a lateral extent greater than that of said lower hull for increased stability when heeled and for planing, said hull portions being merged at one of the waterlines of said yacht.

23. The sailing yacht of claim 22 further including a dynamic ballasting and deballasting system for shifting the waterline between first and second positions comprising:

a plurality of water ballast tanks located to port and to starboard within said hull so that said tanks can be filled and emptied of an amount of water to shift between said waterlines.

24. The sailing yacht as in claim 22 further in which said upper hull is generally bulbous in shape, curving in and flaring toward said lower hull as it merges into said waterline.

25. The sailing yacht as in claim 22 further in which said upper hull forms topsides for said yacht that are of circular form, lying on a generally circular shape at the midsection of said hull.

26. The sailing yacht as in claim 7 further including means for sensing angle of heel of said yacht, means for generating a demand signal representing the desired angle of heel, and means responsive to said demand signal for shifting said ballast to windward to counter said heeling movement by the demanded amount.

27. The sailing yacht as in claim 26 in which said sensing means is a gyro responsive to the heeling angle of said hull.

28. The sailing yacht as in claim 7 in which said means for mounting said ballast includes a bearing block mounted in said hull and aligned fore and aft therein, a journal shaft carried by said strut means and set into said bearing block so that said strut means is swingable to port or starboard about said shaft.

29. The sailing yacht as in claim 28 in which said bearing block opens through said hull, and in which said strut means extends through said opening, and seal means carried in said bearing block for sealing said bearing against passage of water into said hull.

30. The sailing yacht as in claim 7 further in which the said means for mounting and moving said ballast includes a bearing mounted shaft, a yoke having port and starboard arms extending downwardly above said strut means, port and starboard pulleys carried on said yoke arms respectively, a drive pulley mounted to said yoke, said pulley being aligned in a common plane with said port and starboard pulleys, a linkage trained around said pulleys, said strut means extending upwardly from said shaft, means for connecting the upper end of said strut means to said linkage for being carried port and starboard therewith in response to rotation of said drive pulley.

31. The sailing yacht as in claim 7 in which said first control means provides a predetermined ratio of movement of the forward foil in relation to a movement of the aft foil.

32. A steering system for a sailing yacht having a hull, comprising fore and aft foils depending from said hull, first control means for turning said foils in opposite directions to port or starboard for creating a yawing moment for steering said yacht, and second control means for turning said foils in the same direction to port or starboard for adjusting the leeway of said yacht.

33. The steering system as in claim 32 wherein said means for turning in opposite direction is carried on said means for turning in the same direction in a manner that provides for each means to be independently operated.

34. The sailing yacht as in claim 32 further including a main helm for steering, and in which said first control means includes a steering linkage connected between said main helm and said foils for counter rotation thereof for cyclic steering and turning of the yacht on its course, a second helm at the steering station, and in which said second control means includes a second steering linkage connected between said second helm and said foils for turning said foils in the same direction for collective steering.

35. The sailing yacht as in claim 32 wherein said foils are hydrodynamically shaped with a high aspect ratio.

36. The sailing yacht as in claim 32 further including means for changing the camber of at least one foil.

37. The sailing yacht as in claim 36 wherein said means for changing the camber includes a main body, an adjustable flap mounted to the aft portion of said main body, and a second adjustable flap mounted on the forward portion of said body.

38. The sailing yacht as in claim 36 wherein the camber is adjustable up to 25 degrees.

39. The sailing yacht as in claim 32 further in which at least one of said foils further includes means for changing the camber thereof, and means adjusting the camber of said foil while underway.

40. A sailing yacht comprising a hull, mast and at least one sail, said hull having port and starboard sides, said hull, when moving over a body of water, causing bow and stern waves to develop fore and aft of a trough formed at the midsection of said hull which waves and trough travel with said yacht as a three dimensional deformation of said water body, and further subjected to a heeling force and leeway from the action of wind on sail, a solid ballast, strut means for mounting said ballast to depend from said hull at the generally location of said trough, said strut means and said ballast having no necessary control over the leeway of said yacht as had been formerly assigned to a keel, means for mounting and for moving said strut means and ballast to port or to starboard to counter said heeling force, fore and aft foils mounted to depend from said hull, extending downwardly and generally into said bow and stern waves, said foils being constructed and arranged to provide the principal resistance to leeway for said yacht, first control means for turning said foils in opposite directions to port or starboard for creating a yawing moment with respect to each other for steering said yacht, and second control means for turning said foils in the same direction to port or starboard for adjusting the leeway made by said yacht, and means for independently operating said first and second control means, a main helm for steering, said first control means including a steering linkage connected between said main helm and said foils for counter rotation thereof for cyclic steering and turning of the yacht on its course, a second helm at the steering station, said second control means including a second steering linkage connected between said second helm and said foils for turning said foils in the same direction for collective steering.

41. In a keelless sailing yacht, a hull, mast, and at least one sail, said yacht being subject to heeling when under sail, a ballast appendage mounted to depend from said hull, fore and aft foils mounted to depend from said hull fore and aft of said ballast for steering and for leeway control, means for shifting said ballast to windward, port or starboard, to counter heeling, said hull having a lower hull portion, and said hull further having an upper hull portion having a lateral extent greater than that of said lower hull portion for increased stability when heeled and for inducing planing, said hull portions being merged at one of the waterlines of said yacht.

42. The hull of claim 41 further including a dynamic ballasting and deballasting system for shifting the waterline between first and second positions comprising:

a plurality of water ballast tanks located to port and to starboard within said hull so that said tanks can be filled and emptied of an amount of water to shift between said waterlines.

43. The hull as in claim 41 further in which said upper hull portion is generally bulbous in shape, curving inwardly as it merges into said lower hull.

44. The hull as in claim 41 further in which said upper hull portion forms topsides having cross-sections lying on a generally circular arc.

45. In a sailing yacht, a hull, mast, and at least one sail, and a solid ballast mounted to depend from said hull, said mast and yacht being subject to heeling away from vertical due to the action of wind on sail, means for shifting said ballast to windward, port or starboard, to counter said heeling, and so return the yacht toward vertical, and means for tilting the mast to weather, port or starboard, to further bring the mast toward or beyond vertical.

46. The sailing yacht as in claim 45 further including means for sensing angle of heel of said yacht, means for generating a demand signal representing the desired angle of heel, and means responsive to said demand signal for shifting said ballast to windward to counter said heeling movement by the demanded amount.

47. The sailing yacht as in claim 46 further including means for generating a tilt demand signal representing the desired angle of said mast, means responsive to said tilt demand signal for moving said mast toward or beyond vertical in response thereto.

48. The sailing yacht as in claim 46 in which said sensing means is a gyro responsive to the angle of heel of said hull.

49. A sailing yacht comprising a sailing hull having a bow, a stern, and a mast, said yacht forming bow and stern wave crests fore and aft of said yacht when underway, a solid ballast, means for supporting said ballast generally below said hull and having a first function of countering heeling thereof under sail, said last named means having no necessary control over the leeway or yawing moment of said yacht, fore and aft foils mounted for rotation about axes lying in the midplane and extending below said hull fore and aft of ballast and generally toward said bow and stern wave crests, said foils providing the principal resistance to leeway of said yacht, first means for turning said foils in opposite directions with respect to each other for creating a yawing moment between them for cyclic steering said yacht, and second means for turning said foils in the same direction to port or starboard for collective steering of said yacht for controlling the leeway of said yacht, said first and second means for turning being functionally separate of each other, said ballast and support means, and said first and second steering means being constructed and arranged so that said functions of countering heeling and resistance to leeway are separated from each other in structures providing functionally separate control.

50. A sailboat comprising a hull, mast and at least one sail, said sailboat being capable of sailing upwind in response to wind forward of abeam which acts on the sail to develop a thrust force in the direction of an upwind course sailed, and a side force tending to heel the boat and to cause leeway, said hull having fore and aft as well as port and starboard orientations thereto, a solid ballast torpedo for providing righting moments to oppose heeling effects from the side forces of said sail, strut means for supporting said ballast torpedo from said hull to oppose the heeling effect of said sail side force while having no necessary effect opposing leeway, a pair of vertical foils mounted to depend from said hull separate from said ballast torpedo, one of said foils being mounted aft and the other of said foils being mounted forward of said torpedo to provide hydrodynamic side forces opposing leeway independently of said ballast torpedo and said strut, means responsive to a control input for cyclic turning of said foils to steer said yacht on its course, means responsive to another control input for collective turning said foils to change leeway of said yacht, said cyclic and collective turning means being independent of effect on the other during operation, whereby the purity of each control input to said is retained.

* * * * *